US010378188B2

(12) United States Patent
Pratt

(10) Patent No.: US 10,378,188 B2
(45) Date of Patent: Aug. 13, 2019

(54) BUCKET, BLADE, LINER, OR CHUTE WITH VISUAL WEAR INDICATOR

(71) Applicant: ROCKLAND MANUFACTURING COMPANY, Bedford, PA (US)

(72) Inventor: William K. Pratt, Bedford, PA (US)

(73) Assignee: ROCKLAND MANUFACTURING COMPANY, Bedford, PA (US)

( * ) Notice: Subject to any disclaimer, the term of this patent is extended or adjusted under 35 U.S.C. 154(b) by 78 days.

(21) Appl. No.: 15/449,412

(22) Filed: Mar. 3, 2017

(65) Prior Publication Data

US 2018/0087246 A1 Mar. 29, 2018

Related U.S. Application Data

(60) Provisional application No. 62/398,945, filed on Sep. 23, 2016.

(51) Int. Cl.
*E02F 9/28* (2006.01)
*E02F 9/26* (2006.01)

(52) U.S. Cl.
CPC ..... *E02F 9/2883* (2013.01); *E02F 9/267* (2013.01)

(58) Field of Classification Search
CPC ..... E02F 9/2883; E02F 9/2833; E02F 9/285; E02F 7/06
See application file for complete search history.

(56) References Cited

U.S. PATENT DOCUMENTS

| | | | | |
|---|---|---|---|---|
| 1,675,283 | A | 6/1928 | Taylor, Jr. | |
| 2,032,875 | A | 3/1936 | Graham | |
| 2,468,905 | A | 5/1949 | Warren, Jr. | |
| 2,549,278 | A | 4/1951 | Yancey | |
| 3,578,092 | A | 5/1971 | Tesch et al. | |
| 3,805,423 | A | 4/1974 | Engel et al. | |
| 3,929,179 | A * | 12/1975 | Hines | B60C 11/24 116/208 |
| 5,063,696 | A | 11/1991 | Smith | |
| 5,081,774 | A | 1/1992 | Kuwano | |
| 5,144,762 | A | 9/1992 | Robinson | |
| 5,337,801 | A | 8/1994 | Materkowski | |
| 5,555,652 | A | 9/1996 | Ashby | |
| 5,579,594 | A | 12/1996 | Pasqualini et al. | |
| 5,713,145 | A | 2/1998 | Ruvang | |
| 5,743,031 | A | 4/1998 | Launder et al. | |
| 6,032,390 | A | 3/2000 | Bierwith | |

(Continued)

FOREIGN PATENT DOCUMENTS

| | | |
|---|---|---|
| CA | 2445795 A1 | 1/2004 |
| EP | 1997647 A1 | 12/2008 |

(Continued)

*Primary Examiner* — Robert E Pezzuto
*Assistant Examiner* — Adam J Behrens
(74) *Attorney, Agent, or Firm* — Vorys, Sater, Seymour and Pease LLP

(57) ABSTRACT

A bucket or blade including a main body having one or more wear indicators. The one or more wear indicators can be inspected and monitored to determine the extent or degree of wear of one or more wear surfaces of the main body of the bucket or blade. Also, a liner having one or more wear indicators configured for use with a bucket, blade, dump truck, or chute of a rock crusher. Also, one or more wear indicators configured for use with a chute of a rock crusher.

21 Claims, 16 Drawing Sheets

(56) References Cited

U.S. PATENT DOCUMENTS

| | | | | |
|---|---|---|---|---|
| 6,457,269 | B1 | 10/2002 | Esterhuyse et al. | |
| 6,854,593 | B2 * | 2/2005 | Boudreau | B65G 15/60 198/502.1 |
| 9,102,476 | B2 * | 8/2015 | Musick | B65G 17/086 |
| 9,724,697 | B2 * | 8/2017 | Steed | B02C 4/00 |
| 10,060,099 | B2 * | 8/2018 | Serrurier | G06F 17/50 |
| 2008/0023225 | A1 | 1/2008 | Lynde et al. | |
| 2010/0275473 | A1 | 11/2010 | Maher | |
| 2011/0225856 | A1 | 9/2011 | Berton | |
| 2012/0131821 | A1 | 5/2012 | Brufau Guinovart et al. | |
| 2014/0102791 | A1 * | 4/2014 | Dupont | E21B 12/02 175/39 |
| 2014/0173948 | A1 * | 6/2014 | Ok | B23P 6/00 37/452 |
| 2016/0130790 | A1 * | 5/2016 | Serrurier | E02F 9/2883 37/450 |

FOREIGN PATENT DOCUMENTS

| | | | |
|---|---|---|---|
| JP | S57091870 | U | 6/1982 |
| WO | 2005045142 | A1 | 5/2005 |
| WO | 2007128068 | A1 | 11/2007 |

* cited by examiner 210
212H
212H
212H

BUCKET, BLADE, LINER, OR CHUTE WITH VISUAL WEAR INDICATOR

RELATED APPLICATION

This application claims benefit of U.S. Provisional Application No. 62/398,945 filed on Sep. 23, 2016, incorporated herein by reference.

FIELD

The present invention is directed to a bucket, bucket liner, blade, blade liner, a crushing chute, and a crushing chute liner comprising a visual wear indicator. For example, the blade or bucket is configured for excavating, grading and/or material handling. Examples of blades or buckets are an excavator bucket, a loader bucket, dozer blade, grader blade, tractor blade, or otherwise earth-working or material handling buckets, or blades. The present invention is also directed to a wear indicator for other wear monitoring applications on heavy equipment, for example, as a wear indicator for a liner of a dump body on a rigid frame haul truck or articulated haul truck and a crushing chute on heavy equipment.

BACKGROUND

Different types of mining and construction machines, such as tractors, bulldozers, backhoes, excavators, motor graders, and mining trucks or equipment commonly employ earth-working or material handling buckets and/or blades to dig, cut, scrap, pick up, move and/or level earth or materials being excavated or loaded.

The earth-working buckets and blades frequently experience extreme wear from repeated contact with highly abrasive materials encountered during operation. Replacement of the buckets or blades, and other implements used in mining and construction machinery can be costly and labor intensive.

Wear indicators have been employed in the replaceable primary ground engaging parts, such as bucket edge blades, teeth, edge protectors, tips, and/or other removable or replaceable components of excavator buckets, loader buckets, and/or earth-working blades to indicate the level of wear of such items so that they can be replaced prior to failure.

However, as opposed to the above-mentioned primary ground engaging parts, the main body of buckets, excavator buckets, backhoe buckets, and loader buckets, namely, the steel plate sides, steel plate shell, and steel plate brackets of the buckets welded together and the main body of blades and earth-working blades, namely, steel plate sides or ends, steel plate shell, steel plate backing (moldboard), and steel plate brackets welded together (which collectively in this specification will be referred to as the main body). The main body does not include the primary ground engaging parts (e.g. blades, wear plates, edge protectors), also wear over time, but typically not as quickly as the primary ground engaging parts. These are permanent parts of the main body, for example parts welded together. The primary ground engaging parts are removeably attached to the main body.

Thus, there exists a need to employ one or more wear indicators in the main body of buckets and blades to indicate the level of wear of the main body so the buckets or blades may be timely repaired or replaced prior to failure to prevent costly downtime during working hours.

SUMMARY

The present invention is directed to improved buckets and blades, in particular for use or implementation on heavy equipment, including excavators, crawler loaders, trenchers, backhoe loaders, backhoes, loaders, motor graders, bulldozers, road building equipment, and tractors employing wear indicators, wear plates, wear liners for buckets and blades, wear and liner wear kits for use in rigid frame haul trucks, as well as articulated haul trucks employing wear indicators.

The terms rigid frame haul truck and articulated haul truck are terms of art. Rigid frame haul trucks are off-highway, rigid dump trucks specifically engineered for use in high-production mining and heavy-duty construction environments. The term rigid dump truck or RDT refers specifically to the rigidity of the chassis. As the name implies, RDTs have a stiff chassis similar to most commercial vehicles. All the components necessary to make the equipment operate is built around this one component that includes the engine, operator's cab, bed, axles, and steering components. They are suitable for well-maintained roads. This type of design is the standard layout for most commercial rigid dump trucks. Articulated dump trucks or ADTs have a two-piece chassis that is connected by a massive articulated joint that serves as the pivot point for front wheel steering and is powered via hydraulic rams on both sides for easy movement. Aside from the unique steering system, there are a myriad of other off-road specific features such as high ground clearance and suspension to allow for operation on steep slopes and rocky terrain. Articulated dump trucks are suitable for off-road operations, but generally not an all-purpose vehicle. On public roadways, driving can be difficult due the steering configuration. It is basically considered suitable for use at a construction site and would have to be transported to another site of operation.

The improved buckets and blades according to the present invention include one or more visual wear indicators on the main body of the improved buckets and blades to provide effective inspection, maintenance, repair and replacement of such buckets and blades. The term "main body" means the assembled shell, sides, and brackets of the bucket and means the shell, sides or ends, backing plate, and brackets of the blade.

The invention employs the visual wear indicator with the permanent parts of the main body, for example parts welded together. These permanent parts are different from the above-mentioned removable primary ground engaging parts.

The visual wear indicators according to the present invention can be integrated in the original construction or assembly of the buckets and blades, or can be added or installed at a later date. The visual wear indicators, for example, can be wear indicator parts or components, for example, wear inserts such as wear pins, wear blocks, wear plates, and/or wear strips installed into the main body of the buckets or blades, or connected to or affixed to one or more surfaces of the main body of the buckets and blades.

The visual wear indicator according to the present invention, can be configured or structured to change state, for example, change appearance upon being worn or exposed to indicate the extent or level of wear of particular parts, components, joints, or other areas of the main body of the buckets and blades. For example, if the parts, components, joints, or other areas of the main body of the buckets and blades (which collectively in this specification will be referred to as main body parts) are made of steel, then the visual wear indicator can be configured to be a different color compared to steel of the main body and/or change color to indicate the extent or level of wear of the working part. Alternatively, the visual wear indicator can be configured to change size to indicate the extent or level of wear of the working part. As a further alternative, the visual wear indicator can be configured to release a chemical or marker (e.g. marking substance such as paint, dye or ink) to indicate the extent or level of wear of the working part.

As an example, the visual wear indicator can be an insert made of a metal (e.g. brass, steel, aluminum, bronze, copper), polymer (e.g. colored polyethylene, polyurethane), resin (e.g. colored polyester, epoxy), chemical (e.g. acid etching chemical, dye), adhesive (e.g. colored adhesive), ceramic, or composite (e.g. carbon, graphite, boron, fiberglass, aramid, KEVLAR). This insert (e.g. pin, threaded pin, rod, threaded rod, block, bar, plate) is inserted or embedded into the wear surface to a particular depth or entirely through a steel surface or plate of the main body of the bucket or blade. The insert can have a different color compared to the metal (e.g. steel) of the particular wear surface(s) being monitored on the main body of the bucket or blade. For example, the visual wear indicator can be a brass insert configured to be installed (e.g. fastened, pressed, screwed, adhered) or deposited (e.g. brazed) into a hole or opening into the metal (e.g. metal plate) of the main body of the bucket or blade beneath the wear surface being monitored or inspected for wear. When the wear surface being monitored or inspected wears down to a particular or predetermined extent or level, the brass insert or deposit becomes exposed to indicate the wear surface has worn down to an extent requiring repair or replacement to avoid structural failure of that particular wear surface (e.g. wear surface in a lower portion of the shell and/or sides of the main body of the bucket or blade).

As another example, the particular wear surface is drilled and filled with colored epoxy resin (e.g. red colored) and then hardened using a chemical catalyst or hardener. Alternatively, the resin can be a type that can be hardened by electromagnetic radiation (e.g. ultraviolet radiation) to make the visual wear indicator. Also, the visual wear indicator can be a steel insert having a different color compared to the steel surfaces and steel plates of the main body of the bucket or blade. The inserts can be arranged in a pattern (e.g. matrix, cell, random), for example, covering the entire main body. For example, the pins can be installed in any area (e.g. 0.5 inches back from the cutting edge of the bucket or blade).

As another example, the visual wear indicator can be configured or constructed to reveal different colors depending on the level or extent of wear (e.g. depth of wear into surface using original surface level as the baseline). For example, the visual wear indicator can be configured or constructed to reveal different colors at different depths into the wear surface compared to the original surface level (e.g. blue colored for 0 mm to 0.5 mm of depth into wear surface being inspected or monitored, yellow colored for 0.5 to 1.0 mm of depth into wear surface, orange colored for 1.0 mm to 1.5 mm of depth into wear surface, and red colored of depth into wear surface). The different colors, for example, to a machine operator, maintenance worker, or safety or maintenance inspector inspecting and monitoring the visual wear indicator located into the wear surface means, for example, the following: blue=new surface, yellow=beginning wear, orange=moderate wear, and red=high wear requiring repair or replacement of surface).

As a further example, the visual wear indicator can be configured or constructed to change appearance with wear. For example, the visual wear indicator can be configured or constructed to change size and/or shape based on wear. For example, the wear indicator grows or diminishes dimensionally in size as the particular wear surface is worn down based upon wear depth. For example, a tapering insert or pin can continuously change size based on wear depth due to wear. Alternatively, the insert can be configured to incrementally change size based on wear depth (e.g. pin having decreasing or increasing diameters at specific depths into the wear surface). For these types of inserts, the size (e.g. diameter for insert pins, length or wide for insert blocks) can be measured (e.g. with ruler, gauge, micrometer, light meter) to monitor and measure the extent or level of wear of the particular surrounding wear surface). Also, the visual wear indicator can be a hole or pattern of holes drilled into the wear surface of a steel plate of the main body to a predetermined depth. When the hole or holes are worn away making a flush surface with the surrounding steel, it is time to repair or replace this wear surface or plate. Alternatively, one or more wear pins each having a length equal to a fraction of the thickness of a plate of the main body of the bucket or blade is installed or embedded into a hole or patterns of holes drilled into the wear surface a predetermined depth or drilled through the particular wear plate. When the wear surface of the plate is worn down to the level to expose the ends of the pins, which ends become flush with the wear surface of the steel plate, this state of no holes existing on the wear surface indicates to an operator or inspector that it is time to repair or replace the particular plate. If the wear pins are made of hardened steel (e.g. hardened steel significantly harder compared to the steel plate of the main body of the bucket or blade), further wear of this plate will further expose the ends of the pins, which will then begin to protrude out of and above the wear surface. The hardened wear pins can be arranged in a pattern, symbol, or indicia (e.g. pins arranged to reveal a word or words such as "STOP" or "DANGER") to indicate extreme wear and possible component failure soon to occur.

As an even further example, the visual wear indicator can be configured to selectively release one or more marking materials (e.g., dye, bluing, ink, paint, colored wax, chemical, air-activated chemical, foaming agent) at one or more wear depths. For example, the insert is a polymer resin containing a marking material embedded or mixed into polymer (e.g. colored polymer resin pin or stick inserted into drilled or machined hole in wear surface, colored glue stick), or an insert containing a solid, liquid, gel marking material.

As another example, the visual wear indicator can be an insert inserted or embedded into an opening or hole, and having an end surface located below the original surface level of the wear surface. The depth of the hole from the surface of the wear surface to the end surface of the inserted or embedded visual wear indicator (e.g. head or end of wear indicating pin) can be measured by eye or by tool (e.g. depth gauge, laser depth gage) to determine the extent or level of wear of the particular wear surface. Again, the visual wear indicator can be colored to color differentiate the visual wear indicator from the steel color surrounding the hole or opening into the steel surface. Also, when the outer wear surface becomes flush with the end of the visual wear indicator, for example, this condition can mean that it is time to repair or replace the particular wear surface.

The visual wear indicators discussed above are constructed or configured as inserts for being inserted or embedded into a hole or opening made into the wear surfaces (e.g. partial depth holes, through holes, machined holes or openings) to be inspected and monitored. Alternatively, the visual wear indicators can be constructed or configured to be connected to or attached to wear surfaces to be monitored and inspected. For example, the visual wear indicators can be separate components or parts connected or attached to the wear surfaces. For example, the visual wear indicators can be wear plates, wear strips, wear blocks, or other structural components, which when worn can indicate the level of wear of the surrounding wear surfaces to which they are attached or connected (e.g. steel wear plate add-on having one or more visual wear indicator such as brass pins inserted or embedded into the surface of a steel wear plate add-on then welded to the wear surface to be monitored). The add-on detector is configured or designed to correlate the wear of the detector to the wear of surrounding wear surfaces of the main body of the bucket or blade.

The visual wear indicator can be configured to indicate wear on an outer surface, inner surface, or both outer and inner surfaces of the main body of the bucket or blade. For example, a visual wear indicator is inserted or embedded into an opening or hole into an outer surface to provide a visual wear indicator on an inner wear surface when worn to a particular depth. Alternatively, the visual wear indicator is inserted or embedded into an opening or hole into an inner surface to provide a visual wear indicator on an outer wear surface when worn to a particular depth. As a further alternative, a visual wear indicator is inserted or embedded in a through hole (e.g. through hole in metal plate of main body of bucket or blade). The visual wear indicator can be configured to partially extend through the hole (e.g. centered in thickness of the steel plate) and then covered or sealed on both ends with steel inserts) providing a visual wear indicator for both the inner and outer surfaces at the particular wear at a same location.

Again, the visual wear indicator according to the present invention can be used to inspect and monitor the bucket or blade for wear. For example, a worn surface can be repaired by replacing a steel plate (e.g. cut out worn surface area by torching, and then replacing with new steel plate or new steel part). Alternatively, a worn surface can be repaired by covering the worn surface with another steel plate or replacement part welded into position. As another alternative, an assembly or entire portion of the bucket or blade can be cut out and replaced (e.g. left or right side, upper half or lower half). As a final alternative, the indicator or arrangement or pattern of multiple wear indicators may indicate the bucket or blade is in a condition not worth repairing and should be scrapped and replaced with an entirely new bucket or blade unit.

The identification of the locations and placement of the visual wear indicators on a bucket or blade according to the present invention can be useful for inspecting and monitoring the degree or level of wear of surfaces, plates, components, sub-assemblies, and the overall condition and integrity of the entire bucket or blade. The locating and placement of the visual wear indicators is dependent on the particular style, model, and application of a particular bucket or blade. For example, visual wear indicators can be applied to each surface, component or part of the main body of the particular bucket or blade. The arrangement or grouping of the visual wear indicators on the surfaces, components or parts can be based on structural and wear computer simulation and modeling of a particular model, size, application, structural arrangement, connections, and other factors contributing to the overall structure and arrangement of a particular bucket or blade.

For example, visual wear indicators can be arranged in a particular pattern (e.g. rows, matrix, shaped pattern, random pattern), on some or all plates and joints forming the main body of the bucket or blade to facilitate monitoring and inspection.

For example, when designing a new model or size of a particular bucket or blade, a prototype or first production unit(s) is wear tested having numerous visual wear indicators on all surfaces and joints in various arrangements on the main body of the bucket or blade. These visual wear indicators are inspected and monitored during wear testing to determine which visual wear indicators are essential for adjusting and making a final determination of the final number, locations, and arrangements of the visual wear indicators for production runs of the particular new bucket or blade so that these new bucket or blades can be effectively monitored and inspected throughout their service lives.

The presently described subject matter is directed to an improved bucket or blade.

The presently described subject matter is directed to an improved inert for a bucket or blade.

The presently described subject matter is directed to a wear plate or wear strip for a bucket or blade.

The presently described subject matter is directed to an improved heavy equipment or tractor bucket or blade.

The presently described subject matter is directed to an improved bucket or blade comprising or consisting of a main body having one or more wear indicators.

The presently described subject matter is directed to an improved bucket or blade comprising or consisting of a main body having one or more wear pins.

The presently described subject matter is directed to a bucket or blade such as a heavy equipment or tractor bucket or blade comprising or consisting of a main body, and a visual wear indicator affixed to the main body, the wear indicator configured to allow a user to visually monitor and inspect the main body to determine an extent or level of wear of the main body of the bucket or blade.

The presently described subject matter is directed to a heavy equipment or tractor bucket or blade, comprising a main body comprising a shell defining a load bearing cavity or surface; and a visual wear indicator installed or affixed to the main body, the wear indicator configured to allow a user to visually monitor and inspect the main body to determine an extent or level of wear of the main body of the bucket or blade.

The presently described subject matter is directed to a bucket or blade such as a heavy equipment or tractor bucket or blade comprising or consisting of a main body having a shell; and a visual wear indicator affixed to the shell of the main body, the wear indicator configured to allow a user to visually monitor and inspect the shell to determine an extent or level of wear of the shell of the main body.

The presently described subject matter is directed to a bucket or blade such as a heavy equipment or tractor bucket or blade comprising a main body comprising multiple steel plates welded together; and a visual wear indicator affixed to the main body, the wear indicator configured to physically change in appearance to indicate wear in a manner to allow a user to visually monitor and inspect the main body to determine an extent or level of wear of a main body of the bucket or blade.

The presently described subject matter is directed to a bucket or blade such as a heavy equipment or tractor bucket or blade comprising a main body having multiple steel plates welded together; and a visual wear indicator affixed to the main body, the wear indicator configured to physically change in color to indicate wear in a manner to allow a user to visually monitor and inspect the main body to determine an extent or level of wear of the main body.

The presently described subject matter is directed to a bucket or blade having a visual wear indicator configured to allow an inspector to determine when a main body of the bucket or blade needs to be repaired or replaced.

The presently described subject matter is directed to a bucket or blade comprising a main body having a visual wear indicator configured to allow an inspector to determine when the main body of the bucket or blade needs to be repaired or replaced, and one or more ground engaging components or parts connected to the main body.

The presently described subject matter is directed to a bucket or blade such as a heavy equipment or tractor bucket or blade comprising or consisting of a main body, and a visual wear indicator affixed to the main body, the wear indicator configured to allow a user to visually monitor and inspect the main body to determine an extent or level of wear of the main body, wherein the visual wear indicator is an insert configured to be inserted or embedded into a wear surface of the main body.

The presently described subject matter is directed to a bucket or blade such as a heavy equipment or tractor bucket or blade comprising or consisting of a main body, and a visual wear indicator affixed to the main body, the wear indicator configured to allow a user to visually monitor and inspect the bucket or blade assembly to determine an extent or level of wear of the main body of the bucket or blade. The visual wear indicator is typically made of at least one metal different from the metal of the bucket or blade body. Preferably the wear indicator is made of at least one metal selected from the group consisting of brass, copper, aluminum, and a steel alloy. Preferably the wear indicator is made of at least one metal selected from the group consisting of brass, bronze, copper, aluminum, and a steel alloy, wherein if desired the wear indicator is made of multiple metals. However, the wear indicator may be made of multiple materials which can be metal, but are not limited to metal.

Preferably the visual wear indicator is a wear pin inserted or embedded into a wear surface of the main body of the bucket or blade assembly. Typically the inserted or embedded wear pin has a smooth cylindrical-shaped outer surface along its length. However, if desired the wear pin inserted or embedded into the wear surface of the main body of the bucket or blade has a serrated cylindrical-shaped outer surface along a portion or its entire length.

The presently described subject matter is directed to a bucket or blade such as a heavy equipment or tractor bucket or blade comprising or consisting of a main body, and a visual wear indicator affixed to the main body, the wear indicator configured to allow a user to visually monitor and inspect the main body to determine an extent or level of wear of the main body, further comprising one or more structural stiffeners disposed on an exterior surface of the main body, wherein the visual wear indicator is covered by the one or more structural stiffeners.

If desired, rather than being embedded, the visual wear indicator is a separate component or part installed in or onto the bucket or blade.

The presently described subject matter is directed to a bucket or blade such as a heavy equipment or tractor bucket or blade comprising or consisting of a main body, and a visual wear indicator affixed to the main body, the wear indicator configured to allow a user to visually monitor and inspect the main body to determine an extent or level of wear of the bucket or blade assembly, wherein the visual wear indicator is a liner configured to cover a wear surface of the bucket or blade.

DETAILED DESCRIPTION

Figure 1:
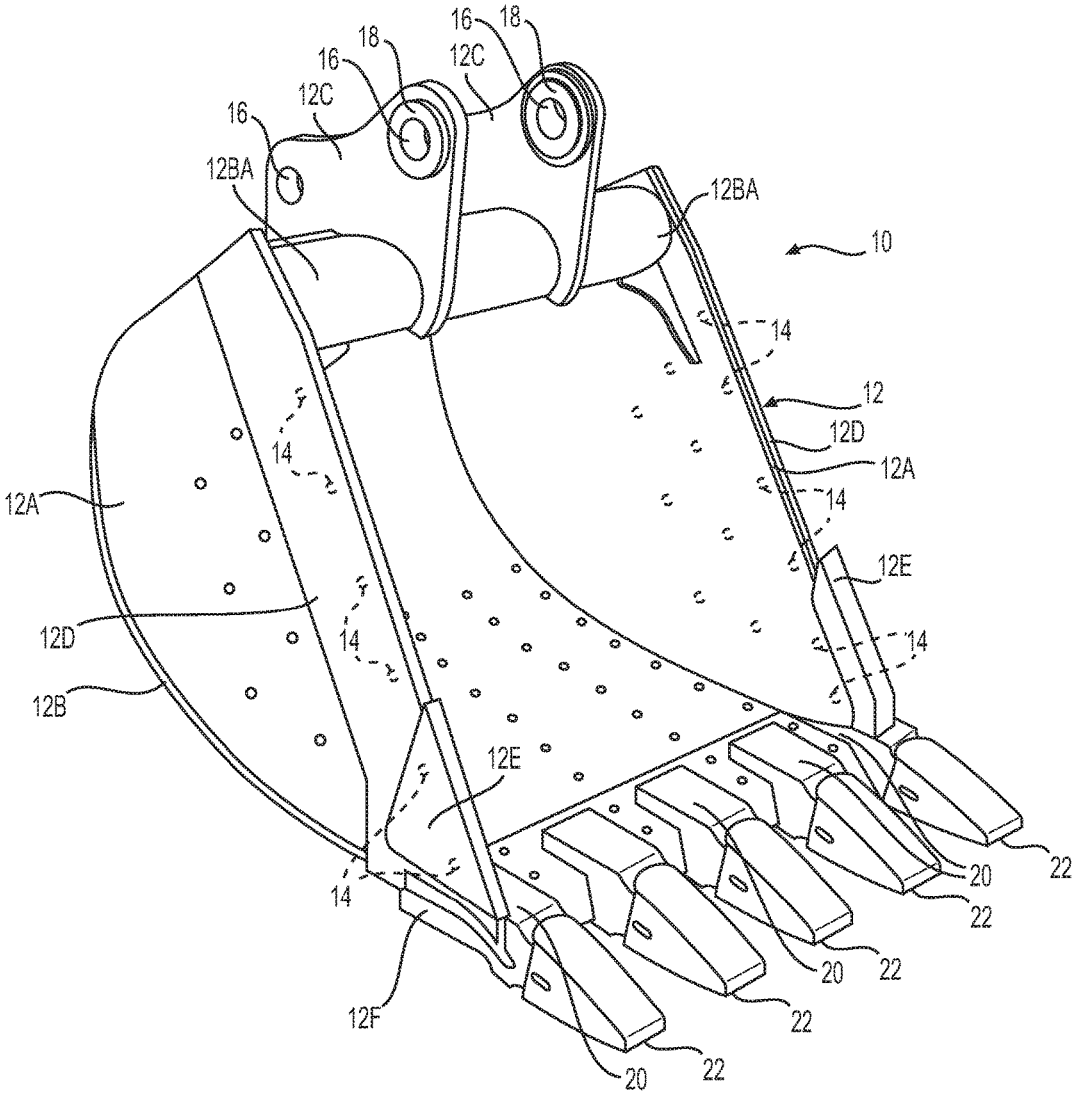
FIG. 1 is a perspective view of an excavator bucket according to the present invention.
Figure 2:
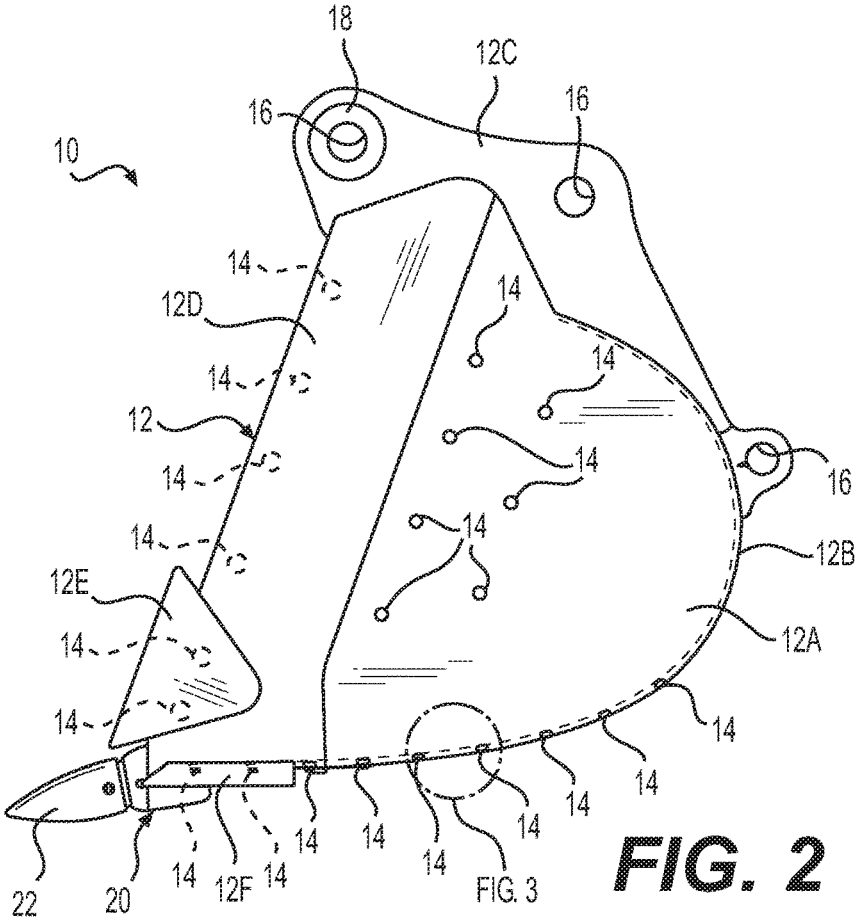
FIG. 2 is a side elevational view of an excavator bucket according to the present invention.
Figure 3:
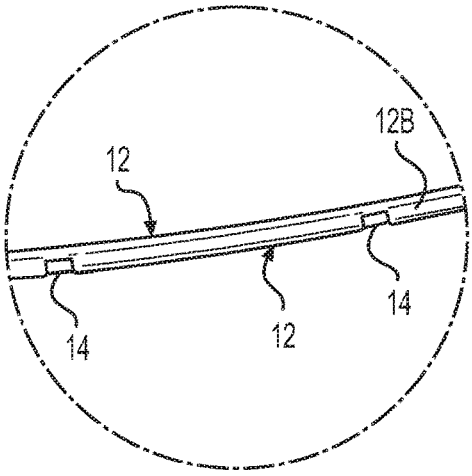
FIG. 3 is an exploded detail cross-sectional view, as indicated in FIG. 2.

A bucket 10 (e.g. excavator bucket, backhoe bucket) according to the present invention is shown in FIGS. 1-3.

The bucket 10 comprises a main body 12 defined by a pair of sides 12A connected to a shell 12B and upper support 12BA. The shell 12B is a curved load bearing plate that defines the floor and back interior surface of the bucket cavity. A pair of brackets 12C is connected (e.g. welded) to the shell 12B and upper support 12BA. The pair of brackets 12C are configured for connecting the bucket 10 to the heavy equipment or tractor (e.g. bucket 10 can be connected to arm or boom of heavy equipment or tractor). The interior surface of the main body 12 defines the load bearing bucket cavity of the bucket 10, and the exterior surface of the main body 12 is located on the opposite side of the walls of the main body 12.

The bucket 10 can further comprise optional primary ground engaging parts such as a set of side wear plates 12D welded to the sides 12A for preventing wear of the leading edges of the sides 12A located adjacent to the opening into the bucket cavity of the bucket 10, another set of side wear plates 12E welded to the side wear plates 12D, and a leading edge blade 12F welded to a forward edge of the shell 12B.

The main body 12 of the bucket 10 is constructed or fabricated of steel plate cut to shape and size, and then assembled together by welding. For example, the sides 12A, brackets 12C, leading side plates 12D, side wear plates 12E, and leading edge wear plate 12F can be made from flat stock steel plate. The shell 12B can be made from flat stock steel plate and then bent into the "bent" configuration shown in FIG. 1. These components or parts are positioned and assembled together by welding. For example, the sides 12A, upper support 12BA, and shell 12B are placed in a jig for positioning and alignment, and then welded together followed by the addition of the brackets 12C, side wear plates 12D, leading edge wear plate 12F, and side wear plates 12E. Of these parts, the shell 12B, upper support 12BA, and sides 12A form the "main body" of the bucket 10, and are the components or parts eligible for a wear indicator according to the present invention. The side wear plates 12D, leading edge wear plate 12F, side wear plates 12E, teeth 22 and teeth supports 20, are not part of the main body.

The stock steel plate used for making the main body 12, for example, can be ⅜" to 1" in thickness. The type of steel used in the main body 12 can be A572 GRADE 50, A514, and AR400 or equivalent.

The bucket 10 is provided with multiple wear indicators 14 (e.g. wear pins, wear plates, wear blocks, wear brackets) located on the sides 12A and shell 12B, for example, as shown in FIG. 1. Also, wear indicators 14 can be located on the side plates 12A, for example, as shown in FIG. 1. These wear indicators 14 can be installed on the inner surfaces, outer surfaces, or both the inner and outer surfaces of the main body 12, depending on the location of wear surfaces on the main body 12. The wear indicators 14 in length can be from 33% to 75% of the thickness of the steel plate used to make the main body 12.

A detailed cross-sectional view of the wear indicators 14 installed on the bucket 10 are shown in FIG. 3. The wear indicators 14 are positioned and configured to indicate the degree or level of wear on lower inner surfaces of the shell 12B (i.e. surface located within bucket cavity). In the vicinity of the wear indicators 14 located in the shell 12B, the inner surfaces of the steel plate of the shell 12B wear thinner with extended use of the bucket 10.

The wear indicators 14 shown in FIG. 3 are installed or embedded into holes made (e.g. drilled) into the outer surface of the shell 12B. For example, a hole is drilled partially through the thickness of the steel plate defining the shell 12B. The wear indicator 14 (e.g. wear pin, wear block) is installed into the hole or opening. For example, the wear indicators 14 are shaped and/or sized to create an interference or friction fit with the hole or opening into the steel plate of the shell 12B. Alternatively, or in addition, the wear indicators 14 are deposited by welding or brazing into the drilled holes. Further, a steel plate (e.g. circular steel plate) can be welded over the drilled opening after installing the wear pins or wear blocks into the holes or openings into the shell 12B to maintain the wear indicators firmly installed in the shell 12B for the life of the shell 12B or bucket 10. The same installation method applies to the installation of the wear indicators 14 on the sides 12A, or other components or parts of the main body 12. In addition, the wear pins can be threaded wear pins, which are threaded or screwed into thread holes made partially through the thickness of the steel plate of the shell 12B. Loctite adhesive (e.g. Loctite Red 262 Threadlocker) can be applied to the threads of the pins prior to installation, so that the threaded pins remain thoroughly installed in the shell 12 when installed throughout the life of the bucket 10.

As shown in FIG. 3, the hole or opening into the steel plate is made through the outer surface of the shell 12B, and only partially through the thickness of the steel plate of the shell 12B. When the interior surface of this steel plate wears down, the inner ends of the wear indicators 14 become exposed to indicate that the shell 12B needs repair or replacement. For example, if the wear indicators 14 are brass pins, the inner ends of the brass wear pins become exposed, and an inspector can then visually see the difference in the brass color of the ends of the brass wear pins compared to the steel color of the surrounding inner surface of steel plate of the shell 12B. Alternatively, the wear indicator 14 can be a steel alloy devised (e.g. treated, dyed) to be a different color compared to the steel plate of the main body 12. For example, the steel pins can be treated (e.g. quenched, tempered) to cause the steel pins to having a different color compared to the steel plate(s) of the main body 12. In addition, the wear pins can be made of a dissimilar metal having a different color compared to the steel plate(s) of the main body (e.g. brass, bronze, copper, aluminum).

Alternatively, the holes or openings in the steel plate of the shell 12A or sides 12A can be made through the entire thickness of the steel plate (i.e. through holes). The brass wear pins can have a length less than the thickness of the shell 12A. These brass pins can be inserted with their outer ends flush with the outer surface of the shell 12A and their inner ends located below the inner surface of the shell 12A. When the inner surface of the shell 12A wears down to the level or location of the inner ends of the brass wear pins, then this condition indicates that it is time to repair or replace the shell 12A.

The brackets 12C of the bucket 10 can be provided with through holes 16 for connecting the bucket 10 to a piece of equipment (e.g. boom of excavator or backhoe), as shown in FIG. 1. One or more of the through holes 16 in the brackets 12C can be reinforced, for example, with a bearing surface (e.g. steel ring) welded to the brackets 12C.

The bucket 10 can further comprise additional optional primary ground engaging parts such as teeth assemblies 20 having teeth 22.

Figure 4:
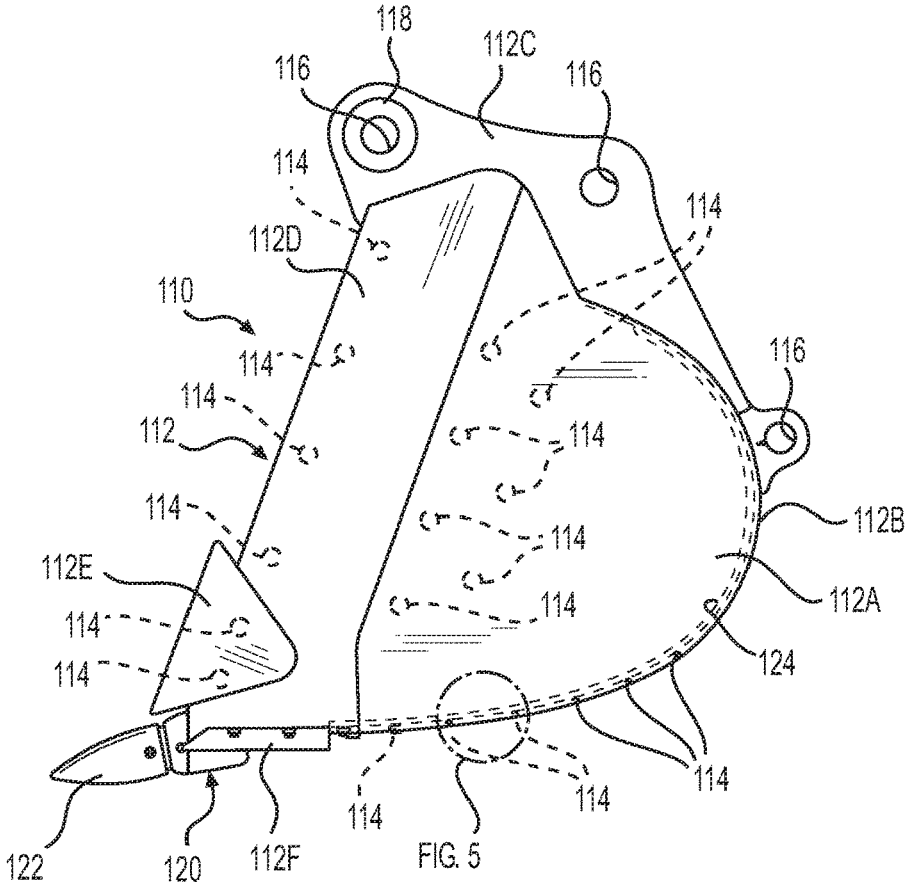
FIG. 4 is a side elevational view of the excavator bucket shown in FIG. 1 fitted with a bucket liner according to the present invention.
Figure 5:
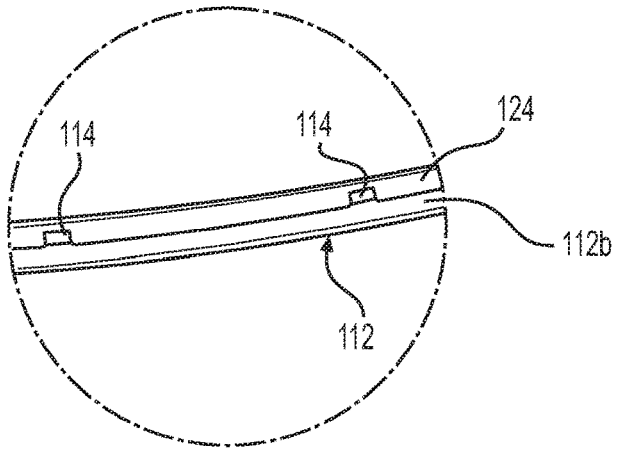
FIG. 5 is an exploded detail cross-sectional view, as indicated in FIG. 4.

Another bucket 110 according to the present invention is shown in FIGS. 4 and 5.

The bucket 110 can be a conventional bucket, or can be the bucket 10 according to the present invention, as shown in FIG. 1.

The bucket 110 includes a removable bucket liner 124 disposed within the bucket 110. The bucket liner 124 can be made from stock sheet steel, and then bent or formed to fit into the bucket 110. The bucket liner 124 can be secured into the bucket 110, for example, by welding and/or fastening. For example, the bucket liner 124 is provided with through holes having edges that can be welded to the inner surfaces of the bucket 110.

The bucket liner 124 is provided with wear indicators 114 so when the inner surface of the bucket liner 124 wears down, the inner ends of the wear indicators become exposed to signal the repair or replacement of the bucket liner 124.

A material handling bucket 210 (e.g. for installation on a wheeled front loader) according to the present invention is shown in FIGS. 6-9.

The bucket 210 comprises a main body 212 defined by a pair of sides 212A connected to a shell 212B. A pair of brackets 212C is connected to the shell 212B.

Figure 6:
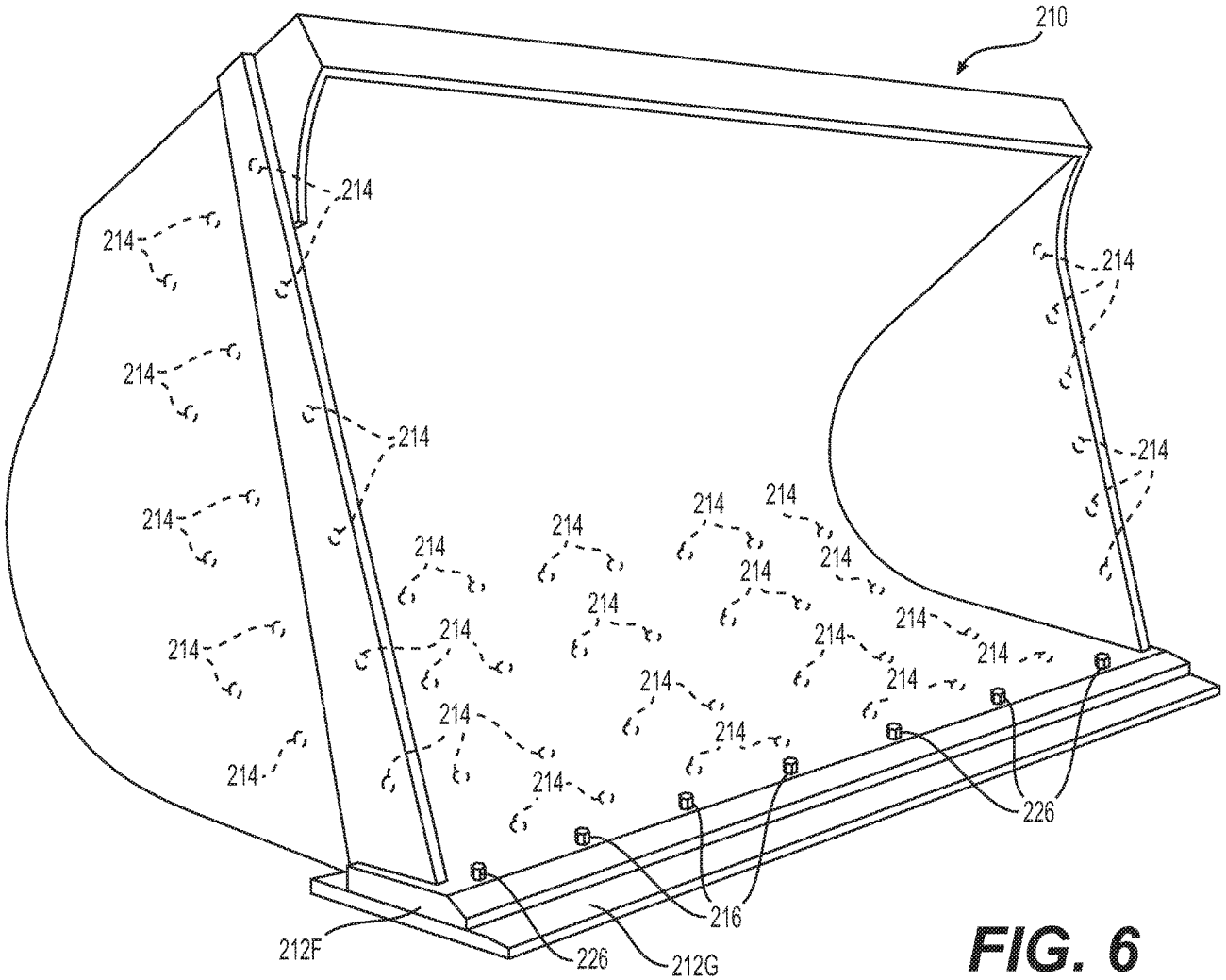
FIG. 6 is a perspective view of a front loader bucket according to the present invention.

The bucket 210 can further comprise optional primary ground engaging parts such as a set of side wear plates 212D welded to the sides 212A for wear protecting the leading edges of the sides 212A located adjacent to the opening into the bucket cavity of the bucket 210, a set of side wear plates 212D, a main leading edge wear plate 212F welded to a forward edge of the shell 212B, and a replaceable leading edge blade 212G fastened by threaded fasteners 226 to the main leading edge wear plate 212F, as shown in FIG. 6. The bucket 210 includes ribs 212H for strengthening the bucket 210.

The main body 212 of the bucket 210 is constructed or fabricated of steel plate cut to shape and size, and then assembled together by welding. For example, the sides 212A, brackets 212C, leading side plates 212D, main leading edge plate 12F, and replaceable leading edge plate 212G can be made from flat stock steel plate. The shell 212B can be made from flat stock steel plate and then bent or formed to have the configuration shown in FIG. 7. These components or parts are positioned and assembled together by welding. For example, the sides 212A and shell 212B are placed in a jig for positioning and alignment, and then welded together followed by the addition of the brackets 212C, leading side plates 212D, and main leading edge wear plate 212F.

The bucket 210 is provided with multiple wear indicators 214 (e.g. wear pins or blocks) located on the shell 212B, as shown in FIG. 6. Alternatively, or in addition, the wear indicators 214 can be provided on the sides 212A. For example, wear indicators 214 can be located on the side plates 212A, and located underneath the side wear plates 212D during construction or assembly of the bucket 210.

Figure 7:
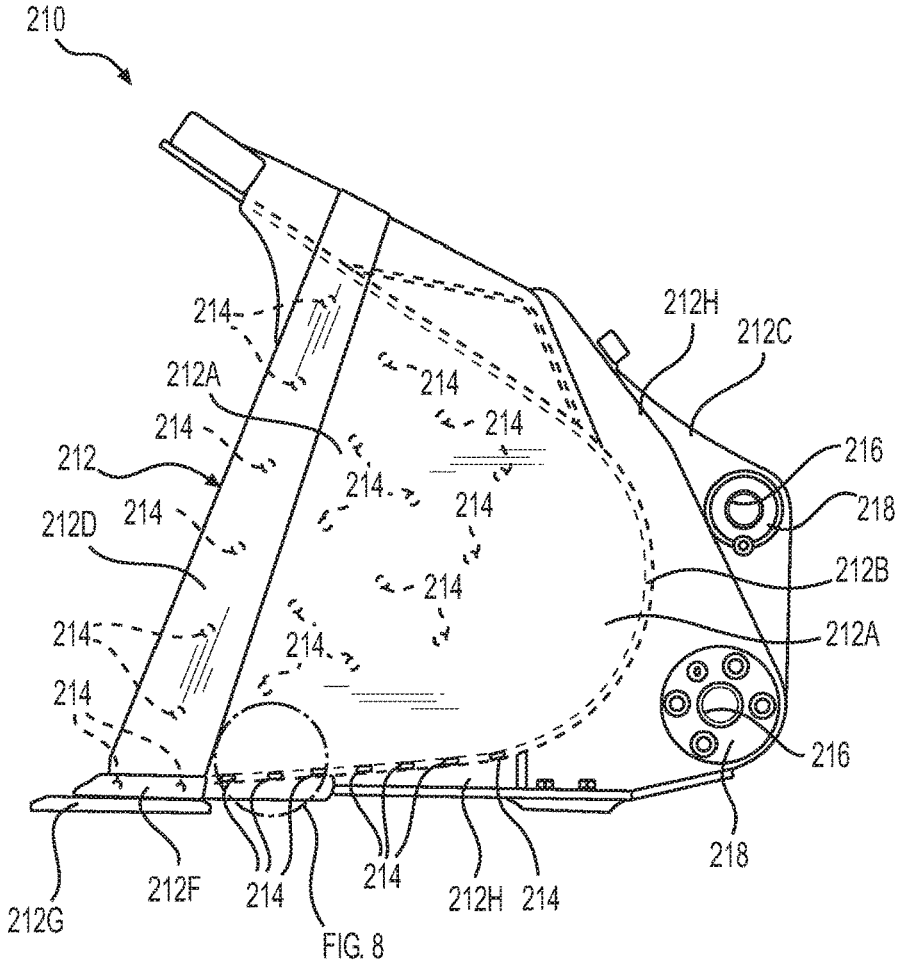
FIG. 7 is a side elevational view of the loader bucket shown in FIG. 6.

A detailed cross-sectional view of the wear indicators 214 installed on the bucket 210 is shown in FIG. 7. The wear indicators 214 are positioned and configured to indicate the degree or level of wear of a lower portion of the shell 212B. In the vicinity of the wear indicators 214 located in the shell 212B, the steel plate of the shell 212B in this vicinity wears thinner with extended use of the bucket 210.

The wear indicators 214 are installed, embedded, or deposited from the outside surface of the shell 212B. For example, holes are drilled or openings are machined in a direction into the thickness of the steel plate defining the shell 212B. The wear indicators 214 (e.g. wear pin, wear block) are installed into the holes or openings. For example, the wear indicators 214 are shaped and/or sized to create an interference, frictional and/or mechanical fit (e.g. pressed, fastened, screwed) into the hole or opening into the steel plate of the shell 212B. Alternatively, or in addition, the wear indicators 214 metal plates are welded or brazed over the holes or openings after the wear pins or blocks are installed in the shell 212B to maintain the wear pins or blocks firmly installed in the shell 212B throughout the life of the shell 212B or bucket 210. As a further alternative, the holes are brazed or welded to deposit metal into the hole. The same installation method can be applied to the installation of wear indicators 214 on the sides 212A.

Figure 8:
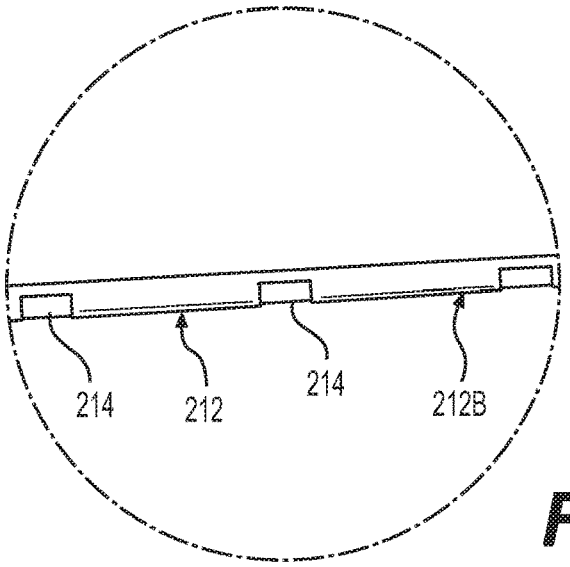
FIG. 8 is an exploded cross-sectional view, as indicated in FIG. 7.
Figure 9:
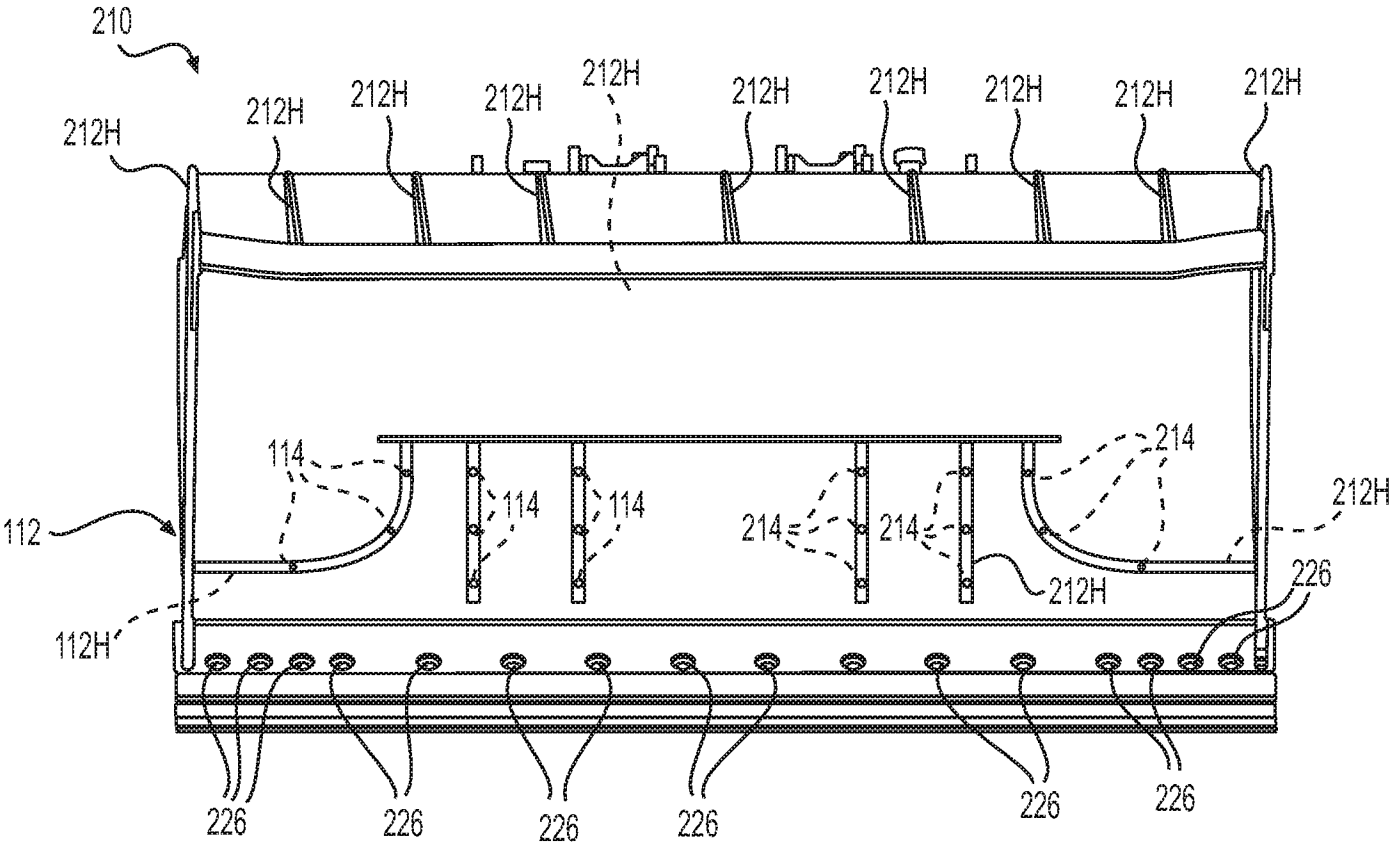
FIG. 9 is a front elevational view of the loader bucket shown in FIG. 6.

As shown in FIG. 8, the hole or opening in the steel plate is made through the outer surface of the shell 212B, and only partially through the thickness of the steel plate of the shell 212B. When the inner surface of this steel plate wears down, the inner ends of the wear indicators 214 become exposed to indicate the shell 212B needs repair or replacement. For example, if the wear indicators 214 are brass pins, the inner ends of the brass wear pins become exposed, and an inspector can then visually see the difference in the brass color of the ends of the brass wear pins compared to the steel color of the surrounding inner surface of steel.

Alternatively, the holes or openings in the steel plate of the shell 212B or sides 212A can be made through the entire thickness of the steel plate (i.e. through holes). The brass wear pins are less than the thickness of the steel plate. The brass wear pins can be inserted with an outer end flush with the outer surface of the steel plate and the inner end thereof located below the inner surface of the steel plate. When the inner surface wears down to the inner ends of the brass indicating pins, this condition indicates that it is time to repair or replace the steel plate.

In the bucket 210 shown in FIG. 6, the wear indicators 214 are located along the points of connection between the reinforcing ribs 212H and the shell 212B. For example, the wear indicators 214 are installed or embedded into the exterior surface of the shell 212B, and then the reinforcing ribs 212H are positioned over the holes or openings containing the wear indicators, and then welded onto the exterior side of the shell 212B.

Figure 10:
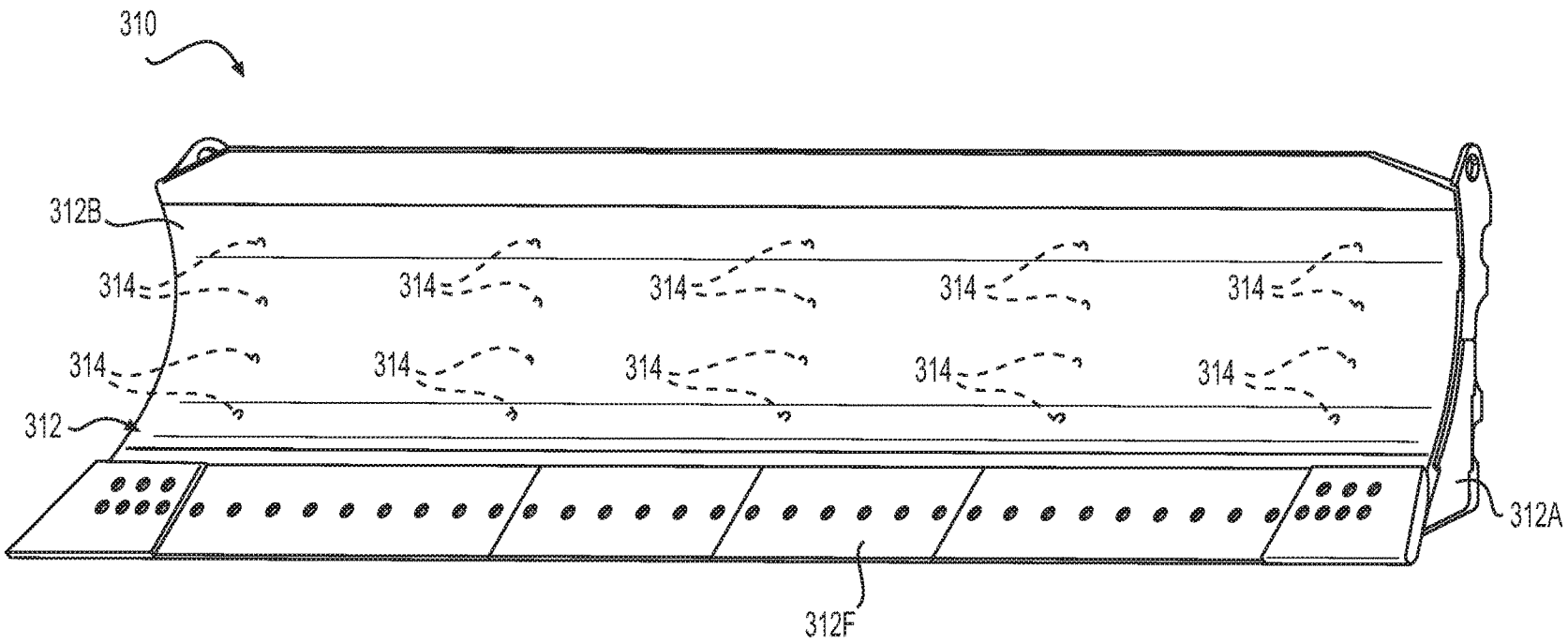
FIG. 10 is a perspective view of a bull dozer blade according to the present invention.
Figure 11:
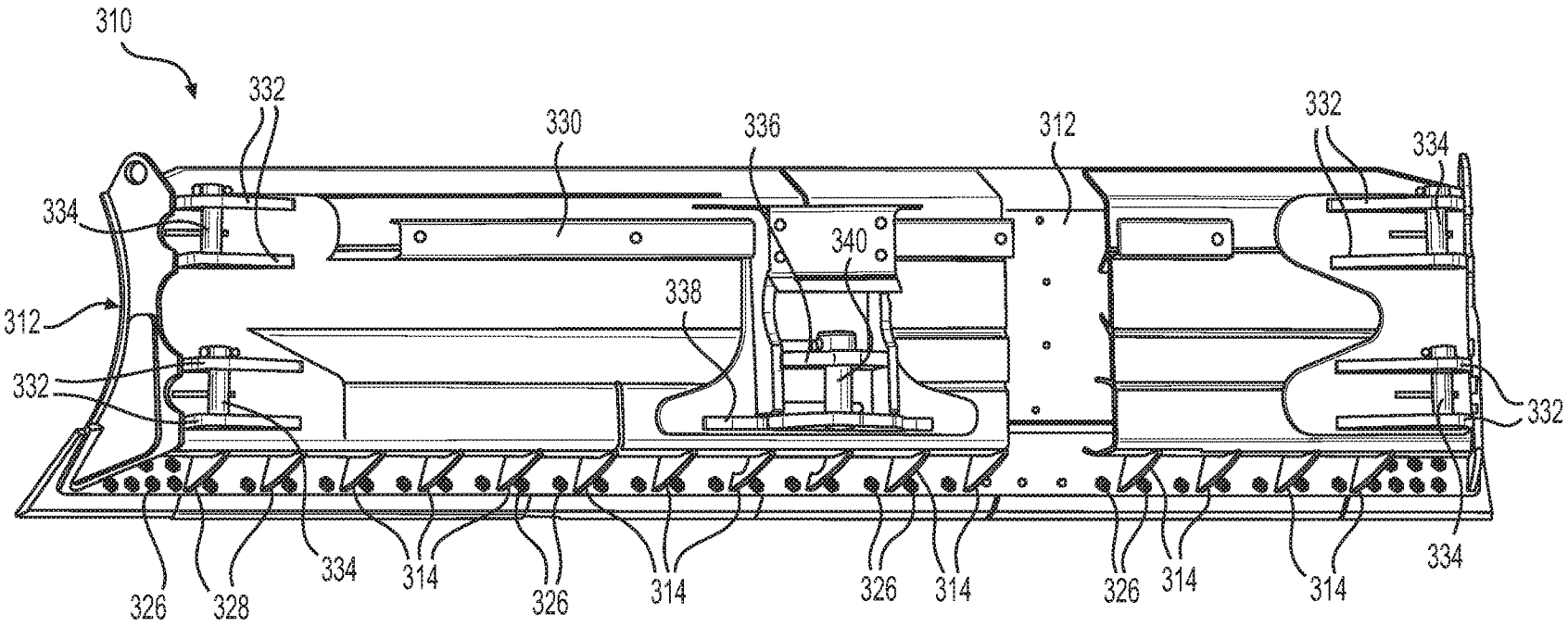
FIG. 11 is a rear elevational view of the blade shown in FIG. 10.

A bulldozer blade 310 according to the present invention is shown in FIGS. 10 and 11.

The bulldozer blade 310 comprises a main body 312 defined by a pair of sides 312A connected to a shell 312B, as shown in FIG. 10. A moldboard 330 is connected to and supports the shell 312B, as shown in FIG. 11. The components or parts are made from steel plate bent, shaped, or formed, and then welded together.

A set of brackets 332 are welded to the moldboard 330. A set of connecting pins 334 connect the brackets 332 to the bulldozer. The reinforcing ribs 338 reinforce the welded connection between the lower end of the shell 312*b* and moldboard 330. The fasteners 326 (e.g. threaded fasteners) removable connect the blade 312F (FIG. 10) to main body 312.

The bulldozer blade 310 is provided with a set of wear indicators 314, as shown in FIG. 10. For example, the wear indicators 314 are brass pins or block installed into holes or opening made into the backside of the shell 312B prior to assembly of the moldboard 330. The wear indicators 314 are located in the vicinity of wear surfaces on the main body 312.

Figure 12:
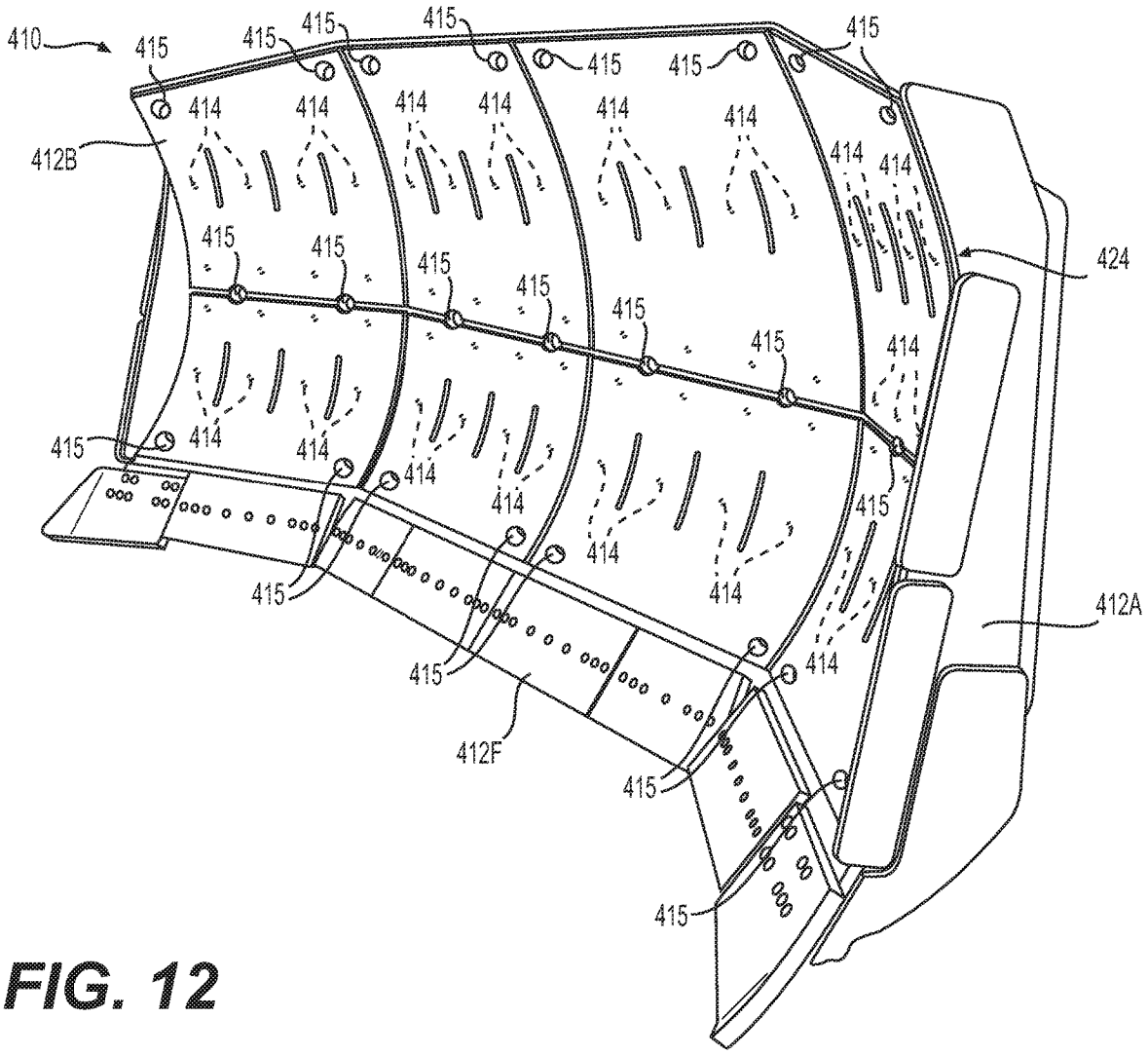
FIG. 12 is a perspective view of the bull dozer blade shown in FIG. 10 fitted with a blade liner.

A bulldozer blade 410 if fitted with a blade liner 424 according to the present invention, as shown in FIG. 12.

The blade liner 424 can be provided with through holes or slots 415 having edges that can be welded to the shell 412B of the blade 410 for installing the blade liner 424 onto the bulldozer blade 410

The blade liner 424 is provided with wear indicators 414, as shown in FIG. 12. For example, the blade liner 424 is made of sheet steel, and the wear indicators 414 are brass wear pins or blocks installed in holes or openings provided in the rear surface of the blade liner 424.

Figure 13:
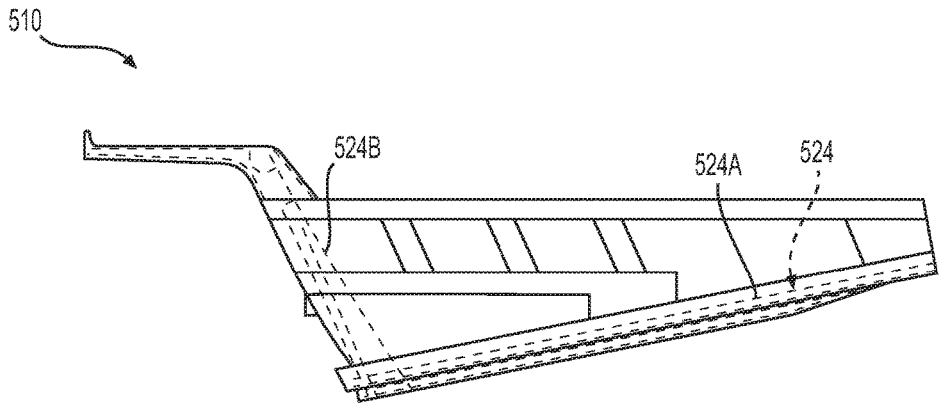
FIG. 13 is a side elevational view of a truck dump body fitted with a dump liner according to the present invention.
Figure 14:
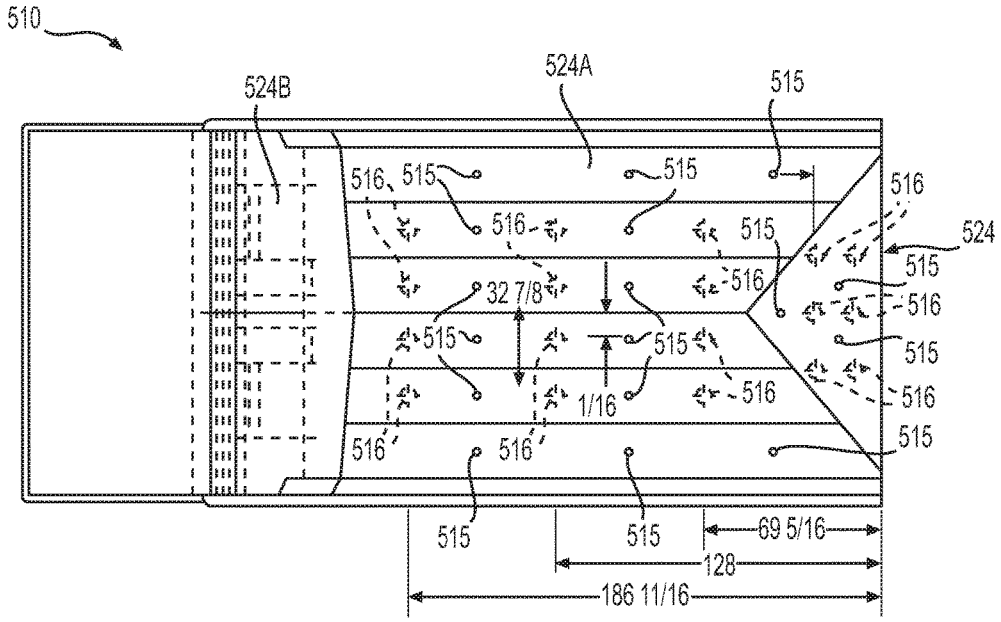
FIG. 14 is a top planar view of the truck dump body fitted with a dump liner shown in FIG. 13.

A dump body 510 of a dump truck is fitted with a dump body liner 524 according to the present invention, as shown in FIGS. 13 and 14.

The dump body liner 524 can be provided with through holes or slots 515 having edges that can be welded to the inner surface of the dump body 510 for installing the dump body liner 524 onto the dump body The dump body liner 524 is provided with wear indicators 514, as shown in FIG. 14. For example, the dump body liner 524 is made of sheet steel, and the wear indicators 514 are brass wear pins or blocks installed in holes or opening provided in a rear surface of the dump body liner 524.

PROPHETIC EXAMPLES

Various prophetic examples of wear indicators according to the present invention are shown in FIGS. 15-29. The wear indicators shown can be installed or embedded into the inner surface and/or outer surface of the steel plate defining the shell 12B or side plate 12A of the main body 12 of the bucket 10, as shown in FIG. 1.

The prophetic examples are applicable to all buckets, blades, and liners described and shown in the drawings in this application. The orientation of the examples shown can be reversed between the upper surface (outer surface) and lower surface (inner surface) shown depending on the particular wear surface application and/or design.

Example 1

Figure 15:
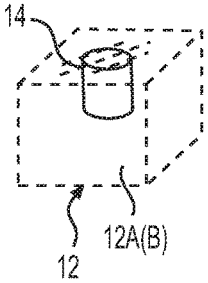
FIG. 15 is a perspective view of a first example of an insert pin installed in a wear surface of the bucket shown in FIG. 1.

A wear indicator 14 in the configuration of a wear pin (e.g. metal or plastic wear pin having a smooth outer surface) is installed or embedded into the steel plate defining the side plate 12A or shell 12B, as shown in FIG. 15. This configuration allows for the wear indicator to indicate wear on either the exterior and interior sides of the steel plate depending on orientation using color differentiation with the steel plate.

Example 2

Figure 16:
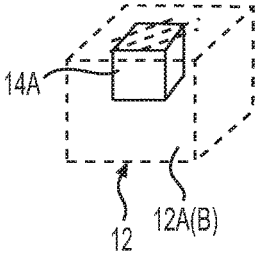
FIG. 16 is a perspective view of a second example of an insert pin installed in a wear surface of the bucket shown in FIG. 1.

A wear indicator 14A in the configuration of a wear block (e.g. metal or plastic wear block) is installed or embedded into the steel plate defining the side plate 12A or shell 12B, as shown in FIG. 16. This configuration allows for the wear indicator to indicate wear on either the exterior and interior sides of the steel plate depending on orientation using color differentiation with the steel plate.

Example 3

Figure 17:
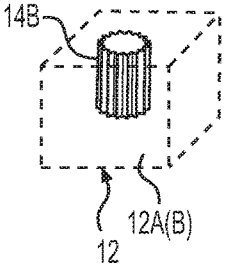
FIG. 17 is a perspective view of a third example of an insert pin installed in a wear surface of the bucket shown in FIG. 1.

A wear indicator 14B in the configuration of a wear pin (e.g. metal or plastic wear pin having a serrated outer surface) is installed or embedded into the steel plate defining the side plate 12A or shell 12B, as shown in FIG. 17. This configuration allows for the wear indicator to indicate wear on either the exterior and interior sides of the steel plate depending on orientation using color differentiation with the steel plate.

Example 4

Figure 18:
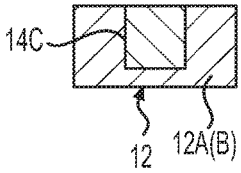
FIG. 18 is a perspective view of a fourth example of an insert pin installed in a wear surface of the bucket shown in FIG. 1.

A wear indicator 14C in the configuration of a wear pin (e.g. metal or plastic wear pin) is installed or embedded into the steel plate defining the side plate 12A or shell 12B, as shown in FIG. 18. The wear indicator 14C extends most of the thickness of the steel plate. This configuration allows for the wear indicator to indicate wear on either the exterior and interior sides of the steel plate depending on orientation using color differentiation with the steel plate.

Example 5

Figure 19:
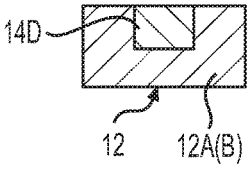
FIG. 19 is a perspective view of a fifth example of an insert pin installed in a wear surface of the bucket shown in FIG. 1.

A wear indicator 14D in the configuration of a wear pin (e.g. metal or plastic wear pin) is installed or embedded into the steel plate defining the side plate 12A or shell 12B, as shown in FIG. 19. The wear indicator 14D extends half way through the thickness of the steel plate. This configuration allows for the wear indicator to indicate wear on either the exterior and interior sides of the steel plate depending on orientation using color differentiation with the steel plate.

Example 6

Figure 20:
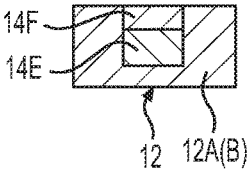
FIG. 20 is a perspective view of sixth example of an insert pin installed in a wear surface of the bucket shown in FIG. 1.

A wear indicator 14E in the configuration of a wear pin (e.g. metal or plastic wear pin) is installed or embedded into the steel plate defining the side plate 12A or shell 12B, as shown in FIG. 20. The wear indicator 14E extends only a portion of the depth of the hole or opening in the steel plate. This configuration allows for the wear indicator to indicate wear on both the interior and exterior sides of the steel plate by color differentiation with the steel plate and/or the hole depth remaining to reach the end of the wear pin on the upper side of the steel plate. An optional steel pin 14F can be installed or embedded over the wear indicator 14E. This configuration allows for the wear indicator to indicate wear on both the exterior and interior sides of the steel plate using color differentiation with the steel plate at the same location.

Example 7

Figure 21:
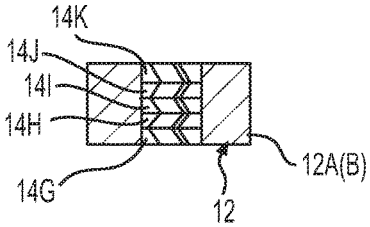
FIG. 21 is a perspective view of a seventh example of an insert pin installed in a wear surface of the bucket shown in FIG. 1.

A wear indicator 14G-K in the configuration of a wear pin (e.g. multi-color layered metal or plastic wear pin or separate inserts) is installed or embedded into the steel plate defining the side plate 12A or shell 12B, as shown in FIG. 21. The wear indicator 14G-K extends the entire depth of the hole or opening in the steel plate. This configuration allows for the wear indicator to indicate wear on both the interior and exterior sides of the steel plate by color differentiation with the steel plate and/or hole depth remaining to reach the end of the wear pin on the upper side of the steel plate. The wear indicator 14G-K can be different colors at different depths to indicate the extent or degree of wear (e.g. blue surface level (new), yellow level (some wear), orange level (more wear), red level (repair or replace).

Example 8

Figure 22:
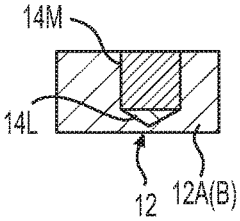
FIG. 22 is a perspective view of an eighth example of an insert pin installed in a wear surface of the bucket shown in FIG. 1.

A wear indicator 14M,L in the configuration of a wear pin (e.g. metal or plastic wear pin or separate inserts) is installed or embedded into the steel plate defining the side plate 12A or shell 12B, as shown in FIG. 22. The wear indicator 14M,L extends almost the entire depth of the hole or opening into the steel plate. This configuration allows for the wear indicator to indicate wear on both the interior and exterior sides of the steel plate by color differentiation with the steel plate and/or size (e.g. diameter) of exposed wear pin or insert. For example, wear on the lower side of the steel plate causes the diameter of the insert to increase due to the tapering structure of the wear pin or insert. The diameter can be measured using a micrometer or surface light meter to determine the extent or degree of wear of the particular wear surface.

Example 9

Figure 23:
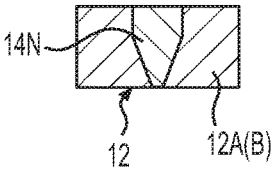
FIG. 23 is a perspective view of a ninth example of an insert pin installed in a wear surface of the bucket shown in FIG. 1.

A wear indicator 14N in the configuration of a tapering wear pin (e.g. metal or plastic tapering wear pin) installed or embedded into the steel plate defining the side plate 12A or shell 12B, as shown in FIG. 23. The wear indicator 14N extends almost the entire depth of the hole or opening into the steel plate. This configuration allows for the wear indicator to indicate wear on the lower surface of the steel plate by color differentiation with the steel plate and/or size (e.g. diameter) of exposed tapering wear pin or insert. For example, wear on the lower side of the steel plate causes the diameter of the insert to increase due to the tapering structure of the wear pin or insert. The diameter can be measured using a ruler, gauge, micrometer, or surface light meter to determine the extent or degree of wear of the particular wear surface.

Example 10

Figure 24:
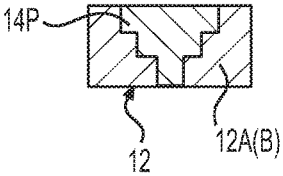
FIG. 24 is a perspective view of a tenth example of an insert pin installed in a wear surface of the bucket shown in FIG. 1.

A wear indicator 14P in the configuration of a tapering wear pin (e.g. metal or plastic stepwise tapering wear pin) installed or embedded into the steel plate defining the side plate 12A or shell 12B, as shown in FIG. 24. The wear indicator 14P extends the entire depth of the hole or opening into the steel plate. This configuration allows for the wear indicator to indicate wear on the lower surface of the steel plate by color differentiation with the steel plate and/or size (e.g. diameter) of exposed stepwise tapering wear pin or insert. For example, wear on the lower side of the steel plate causes the diameter of the insert to incrementally increase due to the stepwise tapering structure of the wear pin or insert. The exposed diameter can be determined by eye, or measured using a ruler, gauge, micrometer, or surface light meter to determine the extent or degree of wear of the particular wear surface.

Example 11

Figure 25:
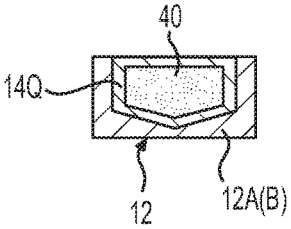
FIG. 25 is a perspective view of an eleventh example of insert pin installed in a wear surface of the bucket shown in FIG. 1.

A wear indicator 14Q in the configuration of a wear pin (e.g. metal or plastic wear pin container or cartridge) installed or embedded into the steel plate defining the side plate 12A or shell 12B, as shown in FIG. 25. The wear indicator 14Q extends most of the depth of the hole or opening into the steel plate. The wear indicator 14Q defines a reservoir 40 containing a chemical (e.g. dye, bluing, paint, etching agent, acid, foaming agent, air hardened colored resin) so that when the wear indicator 14Q is sufficiently worn, it begins to release or leak a chemical selected to provide visual detection or enhance visual detection to indicate that the wear surface is ready for repair or replacement.

This configuration allows for the wear indicator to indicate wear on the lower surface of the steel plate by color differentiation with the steel plate, size (e.g. diameter) of the exposed tapering wear pin or insert, change of texture of surrounding wear surface, change of color of surround wear surface, and/or release of chemical causing foaming and/or hardening on the steel wear surface and/or the material being dug, graded, scrapped (e.g. chemical causes patterning or coloration of dirt or soil). For example, wear on the lower side of the steel plate causes the diameter of the insert to increase due to the stepwise tapering structure of the wear pin or insert. The exposed diameter can be measured using a ruler, gauge, micrometer, or surface light meter to determine the extent or degree of wear of the particular wear surface. Alternatively, the wear pin contains a spring loaded inner pin of color marking substance (e.g. colored waxy substance) released or ejected upon sufficient wear to the wear surface.

Example 12

Figure 26:
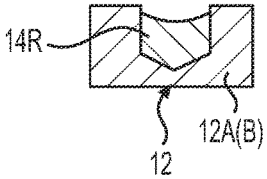
FIG. 26 is a perspective view of a twelfth example of an insert pin installed in a wear surface of the bucket shown in FIG. 1.

A wear indicator 14R in the configuration of a wear pin (e.g. hardened resin such as colored epoxy (red) installed or embedded into the steel plate defining the side plate 12A or shell 12B, as shown in FIG. 26. The wear indicator 14R extends a portion of the depth of the hole or opening into the steel plate. This configuration allows for the wear indicator to indicate wear on the lower surface of the steel plate by color differentiation with the steel plate and/or size (e.g. diameter) of exposed stepwise tapering wear pin or insert. For example, wear on the lower side of the steel plate causing the diameter of the insert to increase due to the tapering structure of the wear pin or insert. The exposed diameter can be determined by eye, or measured using a ruler, gauge, micrometer, or surface light meter to determine the extent or degree of wear of the particular wear surface.

Example 13

Figure 27:
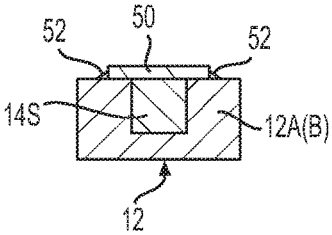
FIG. 27 is a perspective view of a thirteenth example of an insert pin installed in a wear surface of the bucket shown in FIG. 1.

A wear indicator 14S in the configuration of a wear pin (e.g. brass pin) installed or embedded into the steel plate defining the side plate 12A or shell 12B, as shown in FIG. 27. A metal plate 50 (e.g. circular-shaped metal plate) is welded at 52 over the brass pin after being installed in a drilled hole to retain the brass pin in the drilled hole through the life of the wear indicator, bucket, blade, and/or liner.

Example 14

Figure 28:
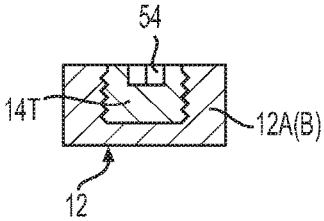
FIG. 28 is a perspective view of a fourteenth example of an insert pin installed in a wear surface of the bucket shown in FIG. 1.

A wear indicator 14T in the configuration of a wear pin (e.g. threaded brass pin) installed or embedded (e.g. threaded or screwed) into the steel plate defining the side plate 12A or shell 12B, as shown in FIG. 28. The wear pin is provided with a receptacle 54 for installing the wear pin into the steel plate (e.g. allen head, slot, shaped receptacle).

Example 15

Figure 29:
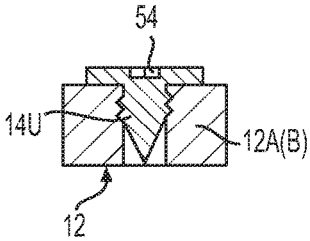
FIG. 29 is a perspective view of a fifteenth example of an insert pin installed in a wear surface of the bucket shown in FIG. 1.

A wear indicator 14U in the configuration of a wear pin (e.g. threaded brass pin) installed or embedded (e.g. threaded or screwed) into the steel plate defining the side plate 12A or shell 12B, as shown in FIG. 29. The wear pin is partially threaded and tapered, and provided with a head having a receptacle 54 for installing the wear pin into the steel plate (e.g. allen head, slot, shaped receptacle). The head can be welded to the side plate 12A or shell 12B for securing the wear pin in the threaded hole throughout the life of the wear indicator, bucket, blade, and/or liner.

Methods of Making

The wear indicators used in the buckets or blades according the present invention can be made or implemented in various manners.

Figure 30:
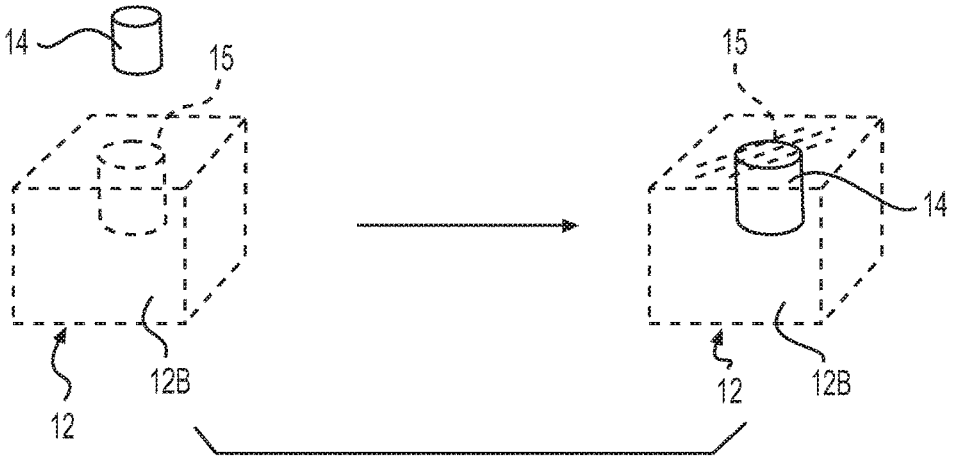
FIG. 30 is a perspective view illustrating a first method of installing a wear detector into a plate component or part of a bucket or blade according to the present invention.

As shown in FIG. 30, a wear indicator 14 in the configuration of a wear pin is made, and then inserted into a hole 15 located in a surface of the metal plate defining the shell 12B of the main body 12 of the bucket or blade (although it could equally be located in sides 12A or liner of the main body 12 of the bucket or blade). For example, the wear pin can be a metal pin made by machining, extruding, rolling or other suitable metal working process or technique. The metal wear pin can be made of brass, bronze, aluminum, metal allow, steel alloy. Alternatively, the wear pin can be a resin, polymer, plastic, composite (e.g. carbon, graphite, KEVLAR aramid, fiberglass) or other suitable synthetic material extruded, molded, machined, or otherwise formed. As a further alternative, the wear pin can be made of ceramic material, for example, extruded, molded or machined ceramic material. The wear pin 14 may be held in the hole 15 by a friction fit or by adhesive or otherwise held in the hole 15, for example by welding or brazing.

Figure 31:
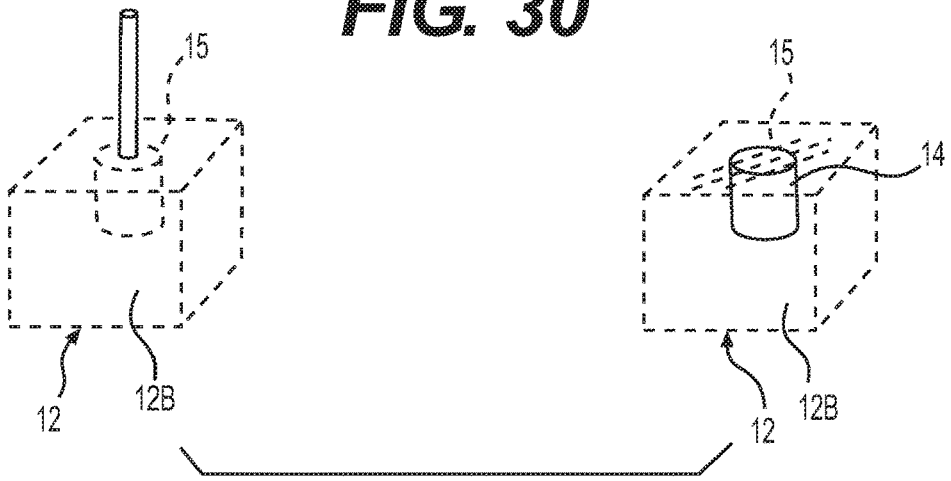
FIG. 31 is a perspective view illustrating a second method of forming a wear detector into a plate component or part of a bucket or blade according to the present invention.

As shown in FIG. 31, a wear indicator 14 is formed in the hole 15 by welding or brazing a material into the hole 15. This is especially suitable when the wear indicator 14 is made of metal and employed with the metal plate defining the shell 12B or sides or liner of the main body 12 of the bucket or blade.

Figure 32:
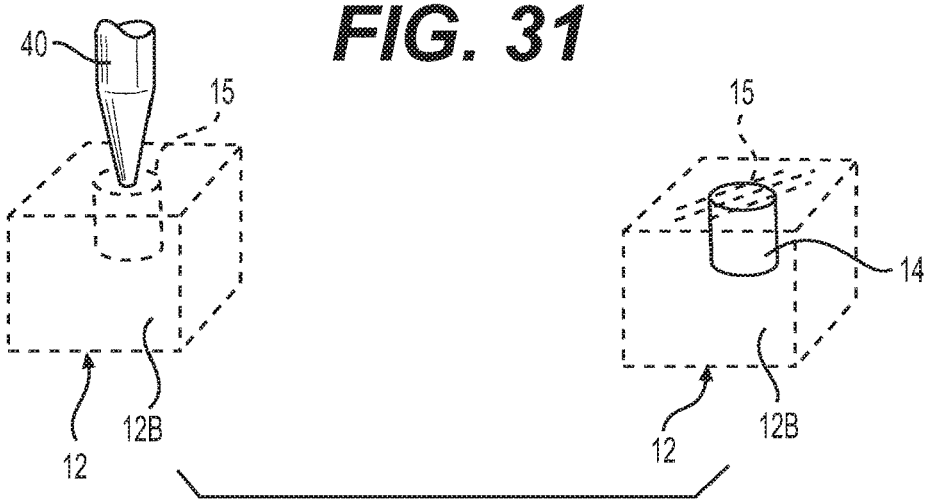
FIG. 32 is a perspective view illustrating a third method of forming a wear detector into a plate component or part of a bucket or blade according to the present invention.

As shown in FIG. 32, a wear indicator 14 is injected into the hole 15 using a nozzle. For example, a colored two-part epoxy (e.g. red) is injected into the hole 15 to become the wear indicator 14 and then hardened by chemical reaction.

Figure 33:
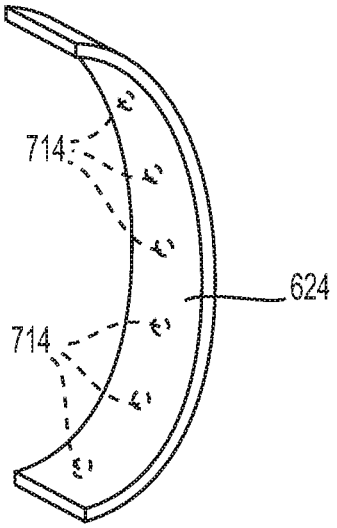
FIG. 33 is a perspective view of a wear strip for installing on the blade shown in FIG. 10.
Figure 34:
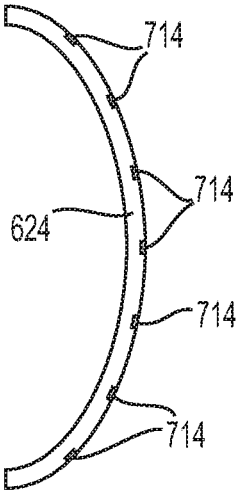
FIG. 34 is a side elevational view of the wear strip shown in FIG. 33.

As shown in FIGS. 33 and 34, the wear indicator can be in the form of a wear bracket 624 having wear indicators 614. The wear bracket 624 is configured to attach (e.g. welded) to the shell of a blade. Thus, the wear bracket 624 can be attached to an existing blade to provide a blade with a wear indicator.

Figure 35:
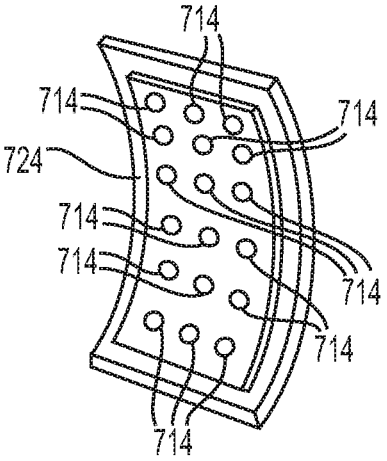
FIG. 35 is a perspective view of a wear plate for installing on a bucket shown in FIG. 1 or blade shown in FIG. 10.
Figure 36:
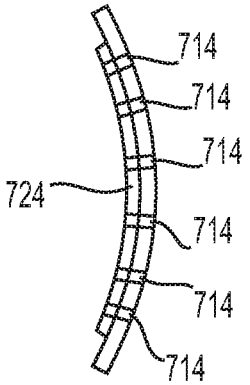
FIG. 36 is a side elevational view of the wear plate shown in FIG. 35.

As shown in FIGS. 35 and 36, the wear indicator can be in the form of a wear plate 724 having wear indicators 714. The wear plate 724 is configured to attach (e.g. welded) to the shell of a bucket, blade, or liner. Thus, the wear plate 724 can be attached to an existing bucket, blade, or liner to provide a blade with a wear indicator.

Figure 37:
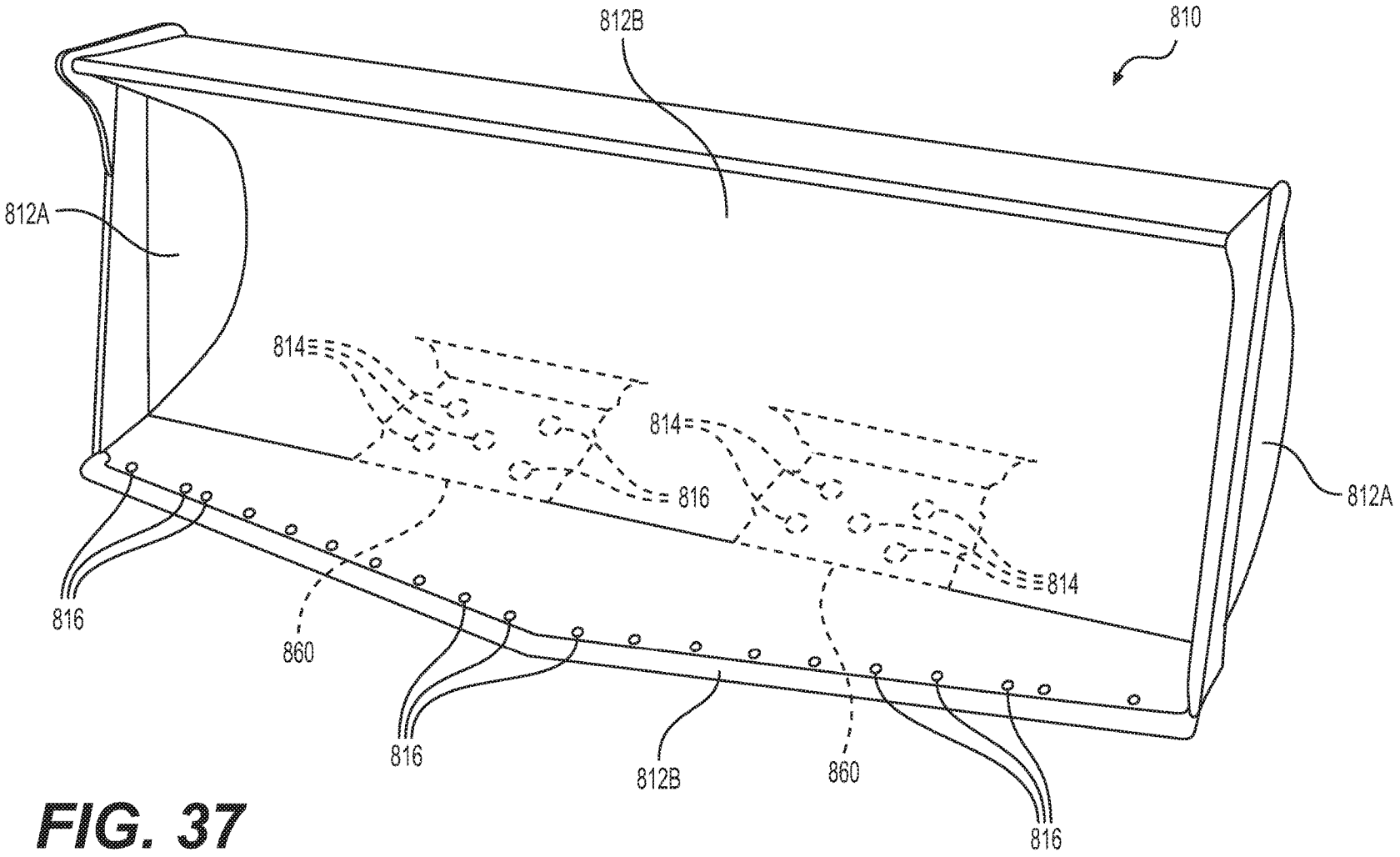
FIG. 37 is a perspective view of another front loader bucket.

Another front loader bucket 810 is shown in FIG. 37. The bucket 810 comprises sides 812A connected to shell 812B. The bucket 810 further comprises a blade 812G connected by fasteners 816 to the shell 812B. The bucket 810 further comprises support pieces 860 that make up the structure of the bucket to give rigidity to the shell. The shell 812B is provided with wear indicators 814 in the pattern as shown (i.e. five wear indicators 814 in a square arrangement with one (1) located in the center).

Figure 38:
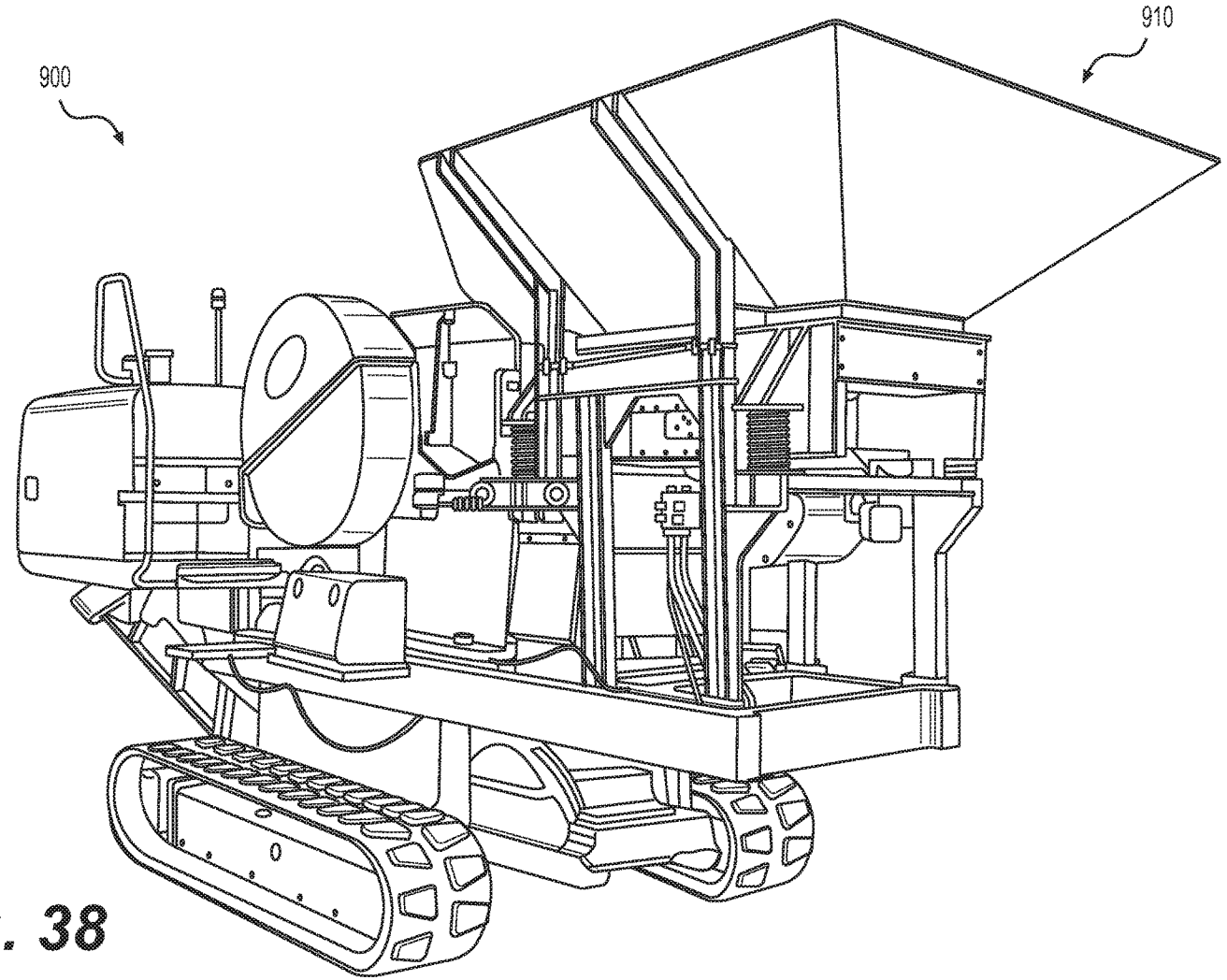
FIG. 38 is a perspective view of a rock crusher.
Figure 39:
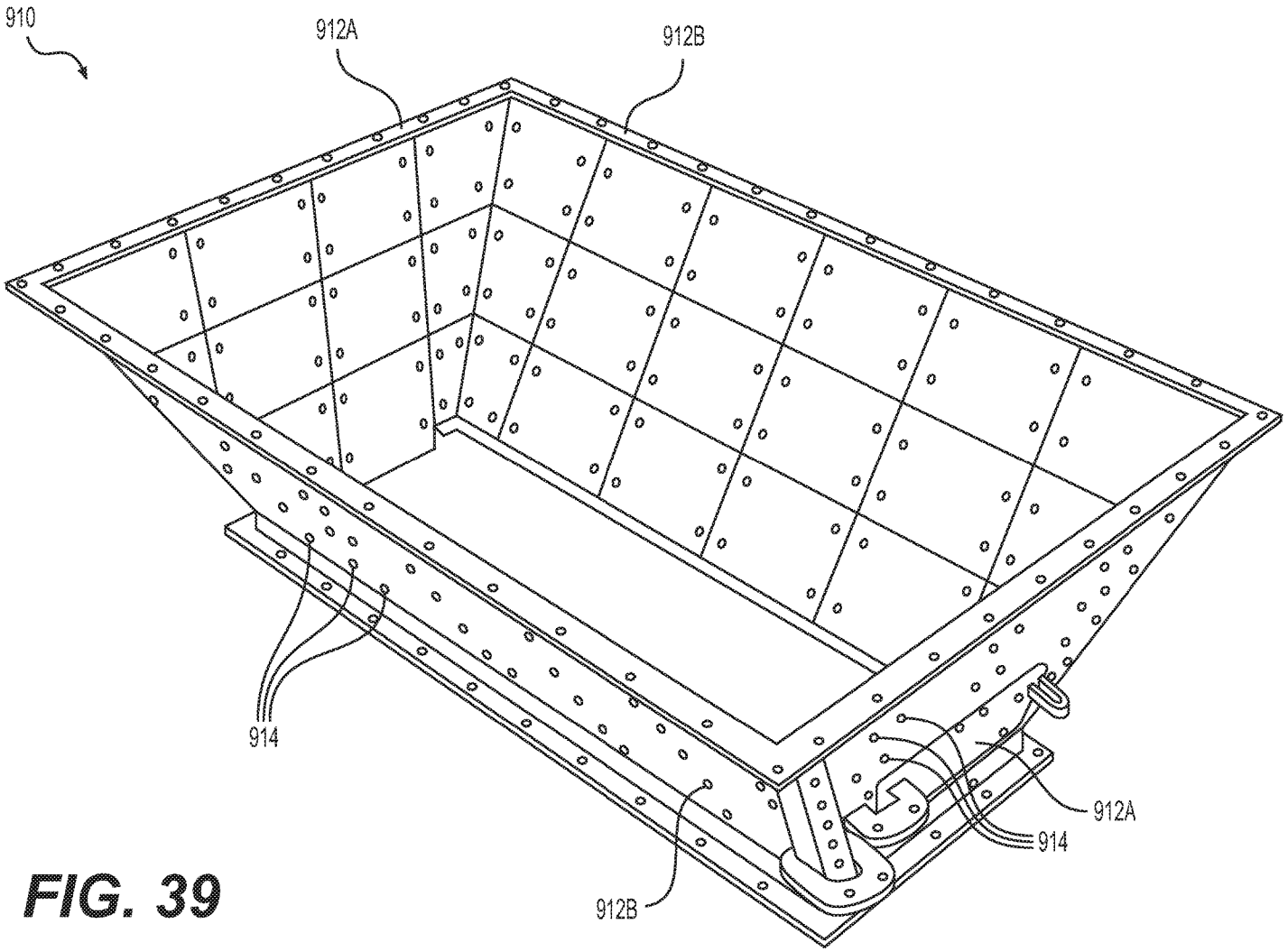
FIG. 39 is a perspective view of a chute located on the rock crusher shown in FIG. 38.

A rock crusher 900 comprising a crushing chute 910 having one or more wear indicators is shown in FIGS. 38 and 39. The sides 912A and 912B of the chute 910 are provided with multiple wear indicators 914, as shown in FIG. 39. The sides 912A and 9126 are made of steel sheet welded together. Alternatively, or in addition, a liner having one or more wear indicators can be installed (e.g. welded) inside the chute 910. For example, the liner is configured to nest within the crushing chute 910 (e.g. having four sides welded together), or can be one to four separate liners shaped to fit inside crushing chute 910 and welded onto the inner side of the sides 912A and 912B.

The invention claimed is:

1. A bucket or blade device, comprising:

a main body comprising a wear layer having a wear surface located at a position on one side of the main body and an opposite surface located at the same position on an opposite side of the main body, the main body having a hole provided into the opposite surface of the main body, the hole partially extending through a thickness of the main body and ending below the wear surface; and a visual wear indicator installed or embedded within the hole provided into the main body, wherein an inner end of the wear indicator becomes exposed when the wear layer having the wear surface on the main body wears down to the inner end of the wear indicator to indicate that the main body needs repair or replacement.

2. The bucket or blade device according to claim 1, wherein the main body comprises a shell connected to a pair of opposed sides.

3. The bucket or blade device according to claim 2, wherein the main body comprises the shell connected to a pair of opposed sides, and wherein the wear indicator is configured to physically change in appearance to indicate wear in a manner to allow the user to visually monitor and inspect the main body to determine the extent or level of wear of the main body of the bucket or blade.

4. The bucket or blade device according to claim 1, further comprising one or more removable ground engaging components or parts connected to the main body of the bucket or blade.

5. The bucket or blade device according to claim 1, wherein the visual wear indicator is an insert configured to be inserted or embedded into the hole.

6. The bucket or blade device according to claim 1, wherein the visual wear indicator is made of at least one metal different from the metal of the main body.

7. The bucket or blade device according to claim 1, wherein the wear indicator is made of at least one metal selected from the group consisting of brass, bronze, copper, aluminum, and a steel alloy.

8. The bucket or blade device according to claim 7, wherein the wear indicator is made of multiple metals.

9. The bucket or blade device according to claim 1, wherein the wear indicator is made of multiple materials.

10. The bucket or blade device according to claim 1, wherein the visual wear indicator is a wear pin inserted or embedded into a wear surface of the main body of the bucket or blade.

11. The bucket or blade device according to claim 10, wherein the wear pin has a smooth cylindrical-shaped outer surface along its length.

12. The bucket or blade device according to claim 10, wherein the wear pin has a serrated cylindrical-shaped outer surface along its length.

13. The bucket or blade device according to claim 1, wherein the visual wear indicator is a separate component or part installed in or onto the main body of the bucket or blade.

14. The bucket or blade device according to claim 1, wherein the main body is constructed of a pair of steel side plates welded to a steel shell plate.

15. The blade or bucket device according to claim 1, wherein the visual wear indicator is made of polymer or resin.

16. The blade or bucket device according to claim 1, wherein the visual wear indicator is an insert or wear pin held in the hole by friction fit or adhesive.

17. The blade or bucket device according to claim 1, wherein the visual wear indicator is a cylindrical-shaped insert or wear pin.

18. The blade or bucket device according to claim 1, wherein visual wear indicator is sized and shaped to fit in contact with the inner surfaces of the hole of the main body when installed within the hole.

19. The blade or bucket device according to claim 1, wherein the hole in the main body comprises a flat inner end.

20. The blade or bucket device according to claim 18, wherein the visual wear indicator is a cylindrical-shaped pin having a flat inner end.

21. The blade or buck device according to claim 19, wherein the flat inner end of the cylindrical-shaped pin contacts with the flat inner end of the hole when installed within the hole.

* * * * *